US007798624B2

(12) United States Patent
Fairchild et al.

(10) Patent No.: US 7,798,624 B2
(45) **Date of Patent: *Sep. 21, 2010**

(54) TRANSPORT SYSTEM FOR SOLID INK IN A PRINTER

(75) Inventors: Michael Alan Fairchild, Vancouver, WA (US); Ernest Isreal Esplin, Sheridan, OR (US); John Albert Wright, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 614 days.

This patent is subject to a terminal disclaimer.

(21) Appl. No.: 11/602,943

(22) Filed: Nov. 21, 2006

(65) Prior Publication Data

US 2008/0117267 A1 May 22, 2008

(51) Int. Cl.
*B41J 2/175* (2006.01)

(52) U.S. Cl. ..... 347/88; 347/99; 347/103

(58) Field of Classification Search ..... 347/88, 347/99, 103

See application file for complete search history.

(56) References Cited

U.S. PATENT DOCUMENTS

| | | | | |
|---|---|---|---|---|
| 3,656,360 | A * | 4/1972 | Fix | 474/250 |
| 4,636,803 | A | 1/1987 | Mikalsen | |
| 5,123,961 | A | 6/1992 | Yamamoto | |
| 5,181,049 | A | 1/1993 | Mackay et al. | |
| 5,223,860 | A * | 6/1993 | Loofbourow et al. | 347/88 |
| 5,276,468 | A | 1/1994 | Deur et al. | |
| 5,341,164 | A | 8/1994 | Miyazawa et al. | |
| 5,386,224 | A | 1/1995 | Deur et al. | |
| 5,442,387 | A | 8/1995 | Loofbourow et al. | |
| 5,510,821 | A | 4/1996 | Jones et al. | |
| D371,157 | S | 6/1996 | Chambers | |
| D371,801 | S | 7/1996 | Jones et al. | |
| D371,802 | S | 7/1996 | Jones et al. | |
| D372,268 | S | 7/1996 | Jones et al. | |
| D372,270 | S | 7/1996 | Jones et al. | |
| D373,139 | S | 8/1996 | Jones et al. | |
| D379,470 | S | 5/1997 | Gilbert | |
| D379,471 | S | 5/1997 | Gilbert | |
| D379,639 | S | 6/1997 | Gilbert | |
| D379,640 | S | 6/1997 | Gilbert | |
| D380,771 | S | 7/1997 | Jones | |

(Continued)

FOREIGN PATENT DOCUMENTS

| | | |
|---|---|---|
| EP | 0683051 | 11/1995 |

(Continued)

OTHER PUBLICATIONS

EP Search Report, European Patent Office, Munich, German, May 19, 2008.

(Continued)

*Primary Examiner*—Manish S Shah
(74) *Attorney, Agent, or Firm*—Maginot, Moore & Beck LLP

(57) ABSTRACT

A solid ink delivery system for use with a plurality of solid ink sticks for use in solid ink printers is provided. The delivery system includes a guide for guiding the solid ink sticks in a prescribed path and a drive member for simultaneous engagement with a plurality of the solid ink sticks and extending along a portion of the prescribed path of the guide.

15 Claims, 18 Drawing Sheets

U.S. PATENT DOCUMENTS

| | | | |
|---|---|---|---|
| D383,153 | S | 9/1997 | Jones et al. |
| D383,154 | S | 9/1997 | Jones et al. |
| 5,689,288 | A | 11/1997 | Wimmer et al. |
| 5,734,402 | A | 3/1998 | Rousseau et al. |
| 5,784,089 | A | 7/1998 | Crawford |
| D402,308 | S | 12/1998 | Yao et al. |
| D403,351 | S | 12/1998 | Yao et al. |
| D403,352 | S | 12/1998 | Brown et al. |
| D403,699 | S | 1/1999 | Chin et al. |
| 5,861,903 | A | 1/1999 | Crawford et al. |
| D407,109 | S | 3/1999 | Yao et al. |
| D407,110 | S | 3/1999 | Yao et al. |
| D407,111 | S | 3/1999 | Brown et al. |
| D407,742 | S | 4/1999 | Yao et al. |
| D407,743 | S | 4/1999 | Yao et al. |
| D407,745 | S | 4/1999 | Brown et al. |
| D408,849 | S | 4/1999 | Chin et al. |
| D409,235 | S | 5/1999 | Chin et al. |
| D409,237 | S | 5/1999 | Ellers et al. |
| D410,026 | S | 5/1999 | Brown et al. |
| D410,490 | S | 6/1999 | Mattern et al. |
| 5,917,528 | A | 6/1999 | Grellmann et al. |
| D412,527 | S | 8/1999 | Ellers et al. |
| D412,528 | S | 8/1999 | Ellers et al. |
| D412,934 | S | 8/1999 | Jones |
| D413,625 | S | 9/1999 | Brown et al. |
| D414,200 | S | 9/1999 | Jones |
| D415,193 | S | 10/1999 | Jones |
| D416,936 | S | 11/1999 | Chin et al. |
| 5,975,690 | A | 11/1999 | Grellmann et al. |
| 5,988,805 | A | 11/1999 | Meinhardt |
| 6,053,608 | A | 4/2000 | Ishii et al. |
| 6,056,394 | A | 5/2000 | Rousseau et al. |
| 6,109,803 | A | 8/2000 | Yasui et al. |
| D436,124 | S | 1/2001 | Mattern et al. |
| D436,989 | S | 1/2001 | Mattern et al. |
| D440,248 | S | 4/2001 | Mattern et al. |
| D440,249 | S | 4/2001 | Ellers et al. |
| D453,786 | S | 2/2002 | Mattern |
| D453,787 | S | 2/2002 | Mattern |
| 6,422,694 | B1 | 7/2002 | Hollands |
| 6,543,867 | B1 | 4/2003 | Jones |
| 6,561,636 | B1 | 5/2003 | Jones |
| 6,565,200 | B1 | 5/2003 | Jones |
| 6,565,201 | B1 | 5/2003 | Jones |
| 6,572,225 | B1 | 6/2003 | Jones |
| D478,347 | S | 8/2003 | Jones |
| D478,621 | S | 8/2003 | Jones |
| D479,368 | S | 9/2003 | Jones |
| D481,757 | S | 11/2003 | Jones |
| D481,758 | S | 11/2003 | Jones |
| D481,759 | S | 11/2003 | Jones et al. |
| D482,062 | S | 11/2003 | Jones |
| D482,063 | S | 11/2003 | Jones et al. |
| D482,388 | S | 11/2003 | Jones |
| D482,389 | S | 11/2003 | Jones |
| D482,720 | S | 11/2003 | Jones et al. |
| D482,721 | S | 11/2003 | Jones |
| D482,722 | S | 11/2003 | Jones |
| 6,648,435 | B1 | 11/2003 | Jones |
| D483,062 | S | 12/2003 | Jones |
| D483,063 | S | 12/2003 | Jones |
| D483,404 | S | 12/2003 | Jones et al. |
| 6,672,716 | B2 | 1/2004 | Jones |
| 6,679,591 | B2 | 1/2004 | Jones |
| 6,705,710 | B2 | 3/2004 | Jones et al. |
| 6,709,094 | B2 | 3/2004 | Jones |
| 6,719,413 | B2 | 4/2004 | Jones |
| 6,719,419 | B2 | 4/2004 | Jones et al. |
| 6,722,764 | B2 | 4/2004 | Jones et al. |
| 6,739,713 | B2 * | 5/2004 | Jones et al. ..... 347/88 |
| 6,746,113 | B1 | 6/2004 | Leighton et al. |
| 6,755,517 | B2 | 6/2004 | Jones et al. |
| 6,761,443 | B2 | 7/2004 | Jones |
| 6,761,444 | B2 | 7/2004 | Jones et al. |
| 6,772,764 | B2 | 8/2004 | Chapman |
| 6,824,241 | B2 | 11/2004 | Sonnichsen et al. |
| 6,840,612 | B2 | 1/2005 | Jones et al. |
| 6,840,613 | B2 | 1/2005 | Jones |
| 6,857,732 | B2 | 2/2005 | Jones et al. |
| 6,866,375 | B2 | 3/2005 | Leighton et al. |
| 6,874,880 | B2 | 4/2005 | Jones |
| 6,893,121 | B2 | 5/2005 | Jones |
| 6,895,191 | B2 | 5/2005 | Rommelmann et al. |
| 6,905,201 | B2 | 6/2005 | Leighton |
| 6,929,360 | B2 | 8/2005 | Jones |
| 6,966,644 | B2 | 11/2005 | Jones et al. |
| 6,981,754 | B2 | 1/2006 | Godil et al. |
| 6,986,570 | B2 | 1/2006 | Jones et al. |
| 7,063,412 | B2 | 6/2006 | Jones et al. |
| 7,066,589 | B2 | 6/2006 | Jones et al. |
| 7,104,635 | B2 | 9/2006 | Jones |
| 2003/0202066 | A1 | 10/2003 | Jones |
| 2003/0202067 | A1 | 10/2003 | Jones et al. |
| 2003/0202069 | A1 | 10/2003 | Jones |
| 2003/0202071 | A1 | 10/2003 | Jones et al. |
| 2003/0202077 | A1 | 10/2003 | Jones et al. |
| 2003/0222930 | A1 | 12/2003 | Jones |
| 2003/0222951 | A1 | 12/2003 | Jones |
| 2003/0222952 | A1 | 12/2003 | Jones |
| 2003/0222953 | A1 | 12/2003 | Jones |
| 2003/0222954 | A1 | 12/2003 | Jones et al. |
| 2003/0222955 | A1 | 12/2003 | Jones |
| 2004/0160498 | A1 | 8/2004 | Jones |
| 2004/0179074 | A1 | 9/2004 | Jones et al. |
| 2004/0183875 | A1 | 9/2004 | Jones et al. |
| 2005/0007428 | A1 | 1/2005 | Joppen |
| 2005/0063820 | A1 | 3/2005 | Awdalla |
| 2005/0146584 | A1 | 7/2005 | Godil et al. |
| 2005/0151814 | A1 | 7/2005 | Wong et al. |
| 2007/0153068 | A1 | 7/2007 | Jones et al. |
| 2008/0088688 | A1 * | 4/2008 | Jones et al. ..... 347/99 |
| 2008/0122907 | A1 | 5/2008 | Jones |

FOREIGN PATENT DOCUMENTS

| | | |
|---|---|---|
| EP | 1122075 | 8/2001 |
| EP | 1359019 A1 | 11/2003 |
| JP | 11115213 | 4/1999 |

OTHER PUBLICATIONS

Non-Final Office Action for U.S. Appl. No. 11/602,710 Mailed Aug. 11, 2009, United States Patent and Trademark Office (7 pages).

Amendment in Response to Non-Final Office Action for U.S. Appl. No. 11/602,710 Submitted Nov. 12, 2009 (13 pages).

Non-Final Office Action for U.S. Appl. No. 11/602,931 Mailed Jun. 9, 2009, United States Patent and Trademark Office (21 pages).

Amendment in Response to Non-Final Office Action for U.S. Appl. No. 11/602,931 Submitted Sep. 8, 2009 (17 pages).

Final Office Action for U.S. Appl. No. 11/602,931 Mailed Jan. 5, 2010, United States Patent and Trademark Office (21 pages).

Non-Final Office Action for U.S. Appl. No. 11/602,937 Mailed Sep. 21, 2009, United States Patent and Trademark Office (7 pages).

Amendment in Response to Non-Final Office Action for U.S. Appl. No. 11/602,937 Submitted Dec. 21, 2009 (8 pages).

Non-Final Office Action for U.S. Appl. No. 11/602,938 Mailed Aug. 7, 2009, United States Patent and Trademark Office (10 pages).

Amendment in Response to Non-Final Office Action for U.S. Appl. No. 11/602,938 Submitted Sep. 2, 2009 (29 pages).

Final Office Action for U.S. Appl. No. 11/602,710 Mailed Mar. 5, 2010 United States Patent and Trademark Office (7 pages).

International Search Report in corresponding European Application No. 07120975.3 mailed Mar. 14, 2008 (5 pages).
Amendment accompanying a Request for Continued Examination for U.S. Appl. No. 11/602,710 submitted Apr. 23, 2010 (5 pages).
Final Office Action for U.S. Appl. No. 11/602,937 Mailed Apr. 14, 2010, United States Patent and Trademark Office (8 pages).
Amendment accompanying a Request for Continued Examination for U.S. Appl. No. 11/602,937 Submitted Apr. 23, 2010 (9 pages).
Amendment accompanying a Request for Continued Examination for U.S. Appl. No. 11/602,931 Submitted Apr. 5, 2010 (9 pages).

* cited by examiner

TRANSPORT SYSTEM FOR SOLID INK IN A PRINTER

1. CROSS-REFERENCE TO RELATED APPLICATIONS

Cross reference is made to the following applications: titled "Printer Solid Ink Transport and Method" and having Ser. No. 11/602,931, titled "Guide For Printer Solid Ink Transport and Method" and having Ser. No. 11/602,937, titled "Solid Ink Block Features for Printer Ink Transport and Method" and having Ser. No. 11/602,710, and titled "Transport System for Solid Ink for Cooperation with Melt Head in a Printer" and having Ser. No. 11/602,938, all of which are filed concurrently herewith and are incorporated herein by reference.

2. TECHNICAL FIELD

The transport system disclosed below generally relates to high speed printers which have one or more print heads that receive molten ink heated from solid ink sticks. More specifically, the transport system relates to improving the ink transport system design and functionality.

3. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages solid ink sticks which remain in solid form at room temperatures. The ink stock can be refilled by a user by simply adding more ink as needed to the ink loader 110. Separate loader channels are used for the different colors. For, example, only black solid ink is needed for monochrome printing, while solid ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink.

In typical prior art solid ink loaders, the ink sticks are positioned end to end in a channel or chute with a melt device on one end and a spring biased push block on the other end. This configuration requires the operator to manually advance the ink in the chute to provide space to insert additional ink sticks, to the extent there is capacity in the channel. This configuration may be somewhat cumbersome for loading large quantities of ink sticks in newer, larger capacity and faster printing products, as the operator has to repeatedly insert an ink stick and then push it forward manually when loading multiple ink sticks in the same channel.

Another issue is that the spring biased push block mechanism limits the amount of ink that can be stored in each channel. Extended capacity loaders with greater length require longer, higher force springs so the push block mechanism can become prohibitably bulky and expensive. Closing an access cover in opposition to the greater spring force needed for larger amounts of ink can be inconvenient or unacceptable to the user during the ink loading process.

Further, constant force springs limit the quantity of ink sticks that may be placed in the chute as the spring biased push block takes space in the chute that otherwise would hold additional ink.

Also, the spring biased push block pushes the ink from the back of the ink sticks, which may lead to undesirable steering or reorienting of the ink. Pushing larger sticks, particularly a longer stack of ink sticks from the back of a stick can lead to buckling and jamming of the sticks. Jamming is more pronounced when there is high feed friction. To minimize friction, a lubricious tape or similar non-stick surface is often used, adding additional cost to the product.

4. SUMMARY

In view of the above-identified problems and limitations of the prior art and alternate ink and ink loader forms, the transport system provides a solid ink supply system adapted for use with solid ink printers.

In one embodiment, a solid ink delivery system for use with a plurality of solid ink sticks (defined here to include even a single or partial ink stick) for use in solid ink printers is provided. The delivery system includes a guide for guiding the ink sticks in a prescribed path and a drive member for simultaneous engagement with a plurality of the ink sticks and extending along a portion of the prescribed path of the guide.

In another embodiment, a printer including a delivery system for use with a plurality of solid ink sticks is provided. The printer includes an ink delivery system having a guide for guiding the ink sticks in a prescribed path and a drive member for simultaneous engagement with one or a plurality of the ink sticks and extending along a portion of the prescribed path of the guide.

In yet another embodiment, a solid ink stick adapted for use with solid ink printers is provided. The ink stick includes a body defining a longitudinal axis of the body. The body defines an external periphery of the body, the external periphery defines a groove formed on the body, and the groove extends in a direction generally along the longitudinal axis of the body.

The ink delivery system for printers disclosed herein uses a driver, for example in the form of a belt, to advance the ink from the loading station to the melting station where molten ink can be transferred to one or more print heads. The many additional described features of this ink delivery system, which can be selectively incorporated individually or in any combination, enable many additional printer system opportunities, including lower cost, enlarged ink storage capacity, as well as more robust feed reliability.

5. BRIEF DESCRIPTION OF THE DRAWINGS

Features of the transport system will become apparent to those skilled in the art from the following description with reference to the drawings, in which.

Figure 20:
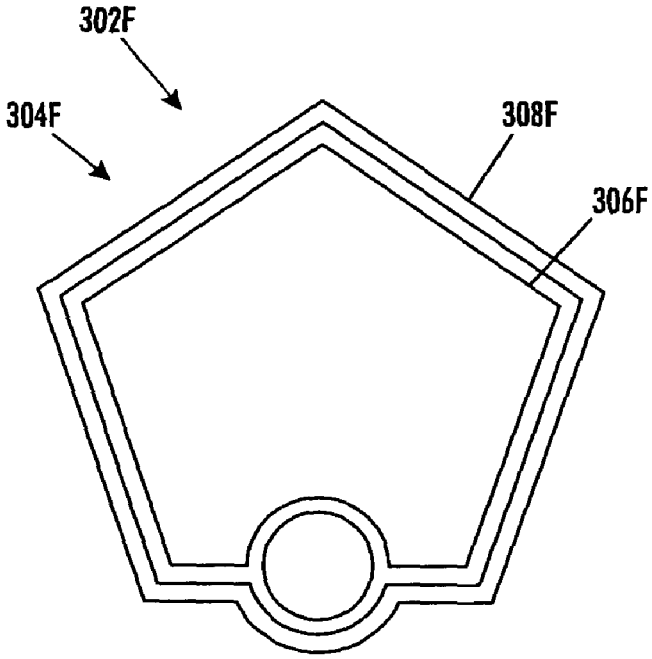
Figure 21:
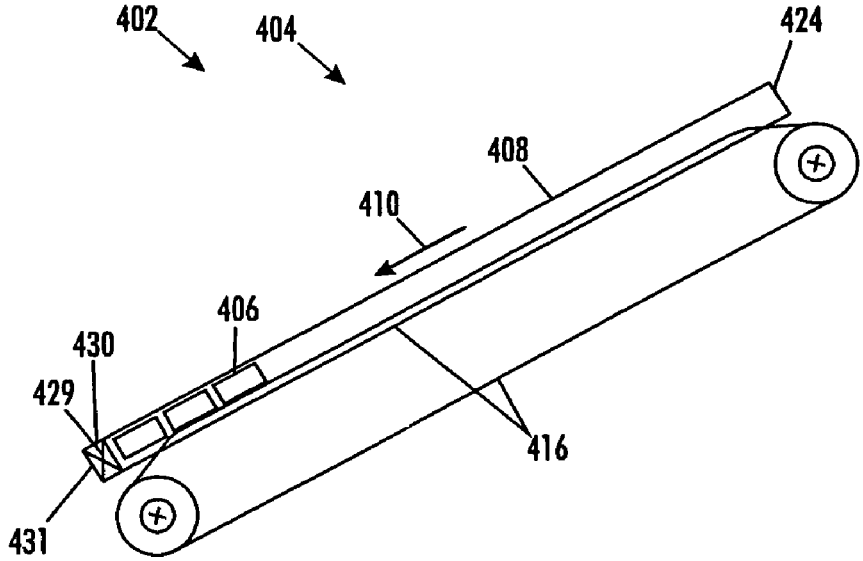
Figure 22:
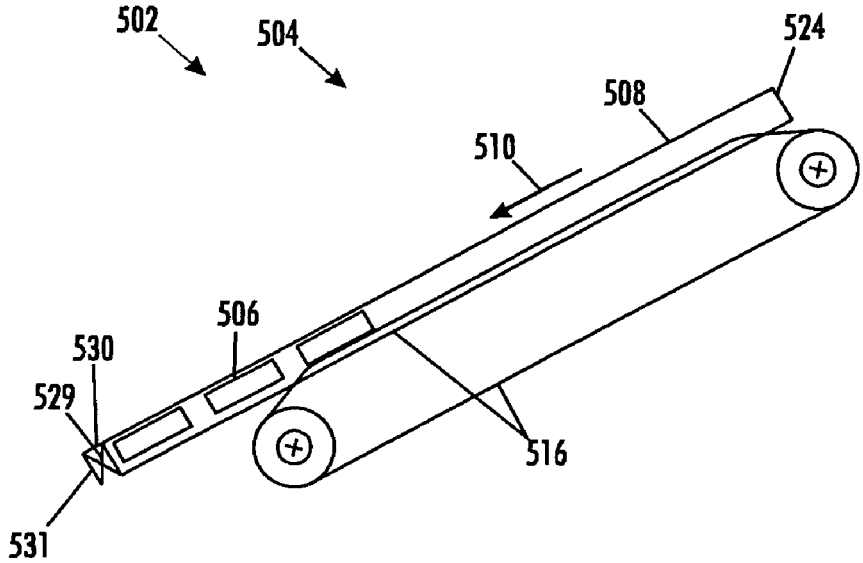
Figure 23:
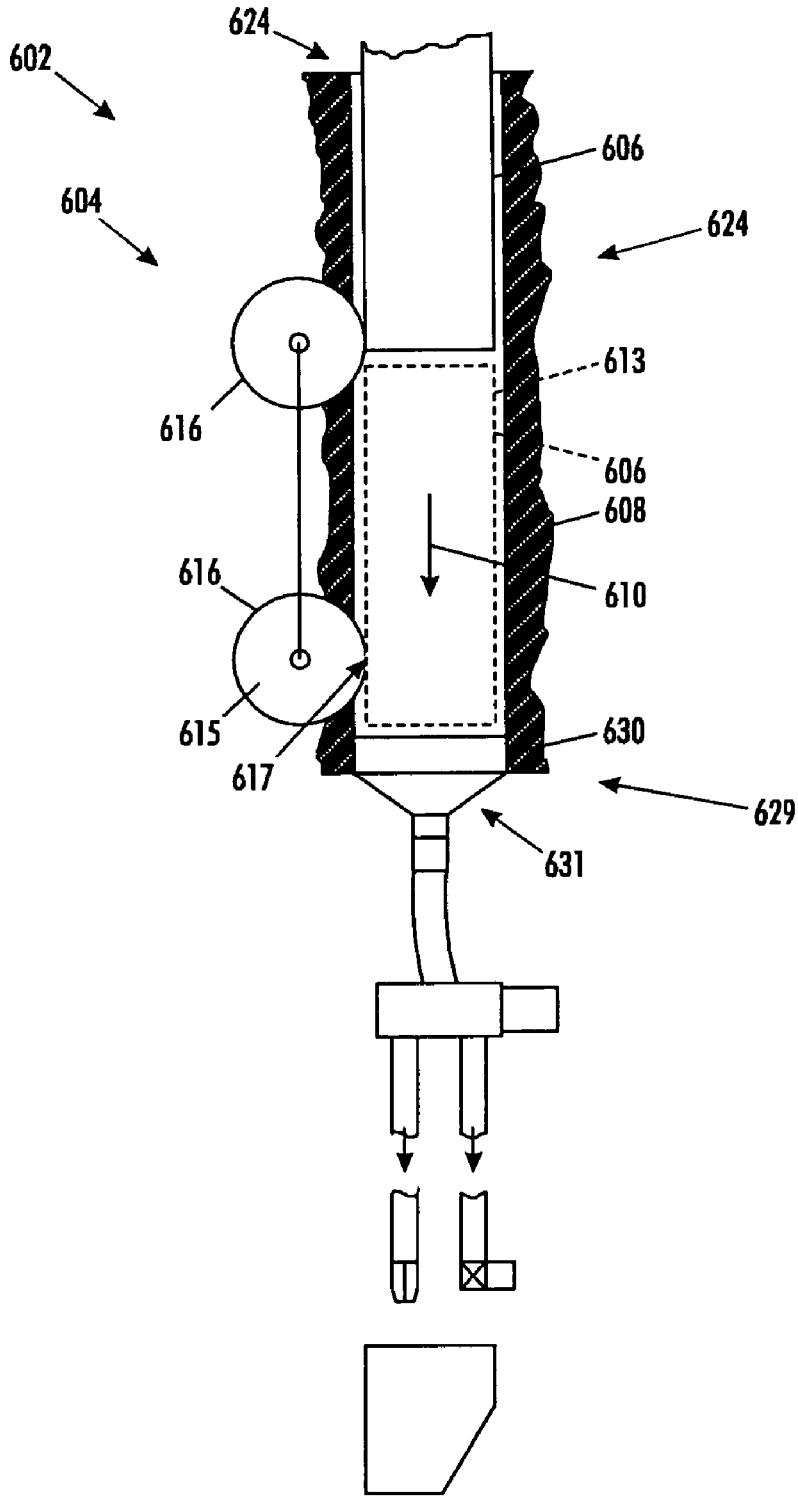

FIG. 20 is a cross sectional view of a pentagonal-shaped chute with a drive member of a solid ink delivery system for use in a printing machine according to another embodiment; and FIG. 21 is a plan view, partially in cross section, of a chute with a drive member extending along the entire length of the chute of a solid ink delivery system for use in a printing machine according to another embodiment;

FIG. 22 is a plan view, partially in cross section, of a chute with a drive member extending from the loading position of the chute to a position spaced from the delivery position of the chute of a solid ink delivery system for use in a printing machine according to another embodiment; and FIG. 23 is a schematic view of a solid ink delivery system for use in a printing machine according to another embodiment.

6. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a print head are intended to encompass the range of intermediate connections, tubes, manifolds, heaters and/or other components that may be involved in a printing system but are not immediately significant to the system disclosed herein.

The general components of a solid ink printer have been described supra. The system disclosed herein includes a solid ink delivery system and a solid ink printer and an ink stick for incorporating the same.

Figure 1:
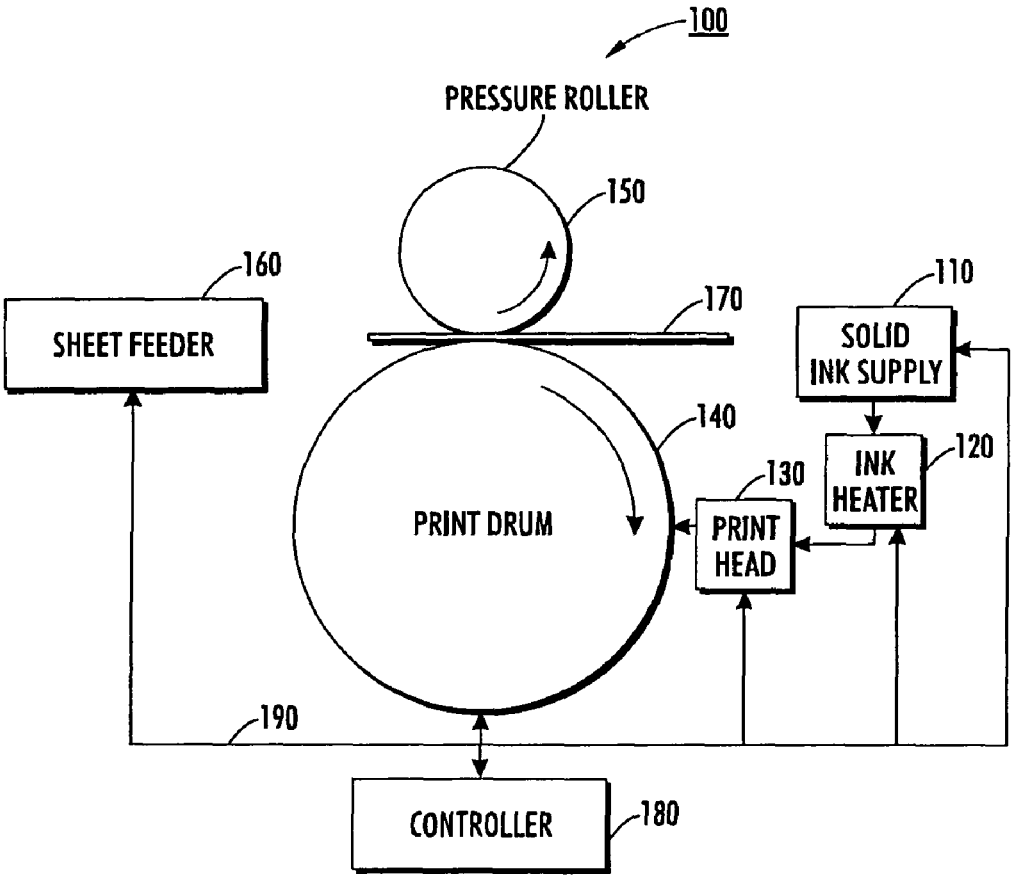
FIG. 1 PRIOR ART
FIG. 1 is a general schematic diagram of a prior art high speed, solid ink printer.
Figure 2:
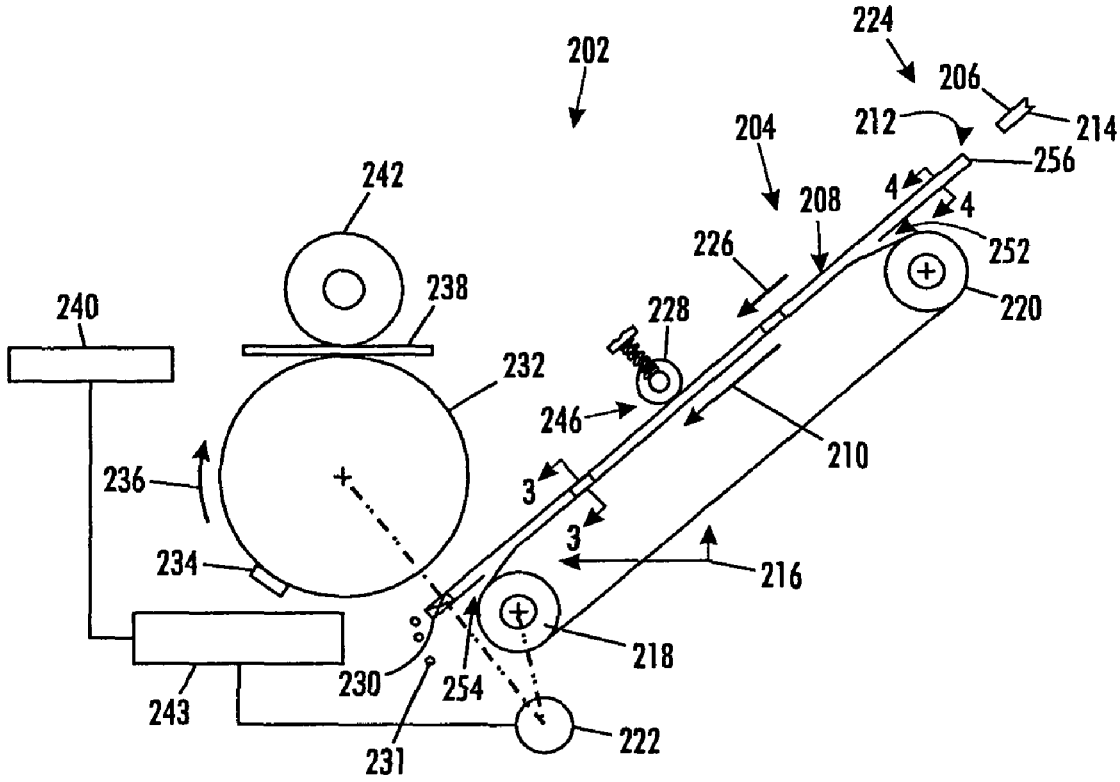
FIG. 2 is a plan view with portions shown as a schematic diagram, of a high speed, solid ink printer with a solid ink delivery system in one embodiment.

Referring now to FIG. 2, a solid ink printer 202 is shown. The printer 202 includes a delivery system 204 for use with a plurality of ink sticks 206. The solid ink delivery system 204 includes a guide function formed in chute 208 for guiding the ink sticks 206 in a prescribed path 210. The chute 208 guide may have any suitable configuration to constrain the ink sticks 206. For example, the chute 208 guide features may be walls, ribs or troughs and, as shown in FIG. 2, be generally linear. An opening 212 may be formed in the chute 208 for receiving or inserting the ink sticks 206. The insertion opening 212 may be formed in a secondary component affixed to the chute and may employ size, shape and keying features exclusively or in concert with features of the chute to admit or exclude ink shapes appropriately. For convenience, the insertion and keying function in general will be described as integral to the chute 208.

The solid ink delivery system 204 further includes a drive member 216 for engagement with a plurality of the ink sticks 206. As shown in FIG. 2, the drive member 216 engages more than one stick at a time. The drive member 216 may simultaneously contact several sticks 206, each stick positioned at a different place in the chute. The drive member 216, as shown in FIG. 2, extends along a portion of the prescribed path 210 of the guide 208. The drive member 216 may have any suitable size and shape and may, as shown in FIG. 2, be in the form of a belt. The belt 216 may, as shown in FIG. 2, be held taut by a pair of spaced apart pulleys in the form of a drive pulley 218 and at least one idler pulley 220. The drive pulley 2218 may be rotated by any suitable device, for example by a motor transmission assembly 222. Alternatively, the drive member may be a considerably smaller percentage of the total feed distance intermediate the insertion and delivery stations.

Referring to FIG. 2, the operation of the solid ink printer 200 is shown schematically. The ink sticks 206 are loaded into the insertion opening 212 area of the chute 208 of the solid ink delivery system 204. The belt 216 of the drive member solid ink delivery system 204 advances the sticks 206 from loading station 224 in the direction of arrow 226. The chute 208 is configured to contain and guide the sticks along the feed path from insertion to melt unit.

As is shown in FIG. 2, the direction of arrow 226 of the ink sticks 206 is in a downward direction. In such orientation, the ink sticks 206 may have a tendency to come loose and advance past the belt 216 due to the effects of gravity. To alleviate this issue, a nudging member 228 may be positioned along the chute 208 to push or nudge the sticks 206 into sufficient contact with the belt 216 to prevent gravity from causing the sticks 206 to slip away from the belt 216. The sticks 206 move along path 210 in the direction of arrow 226 and advance to melting station 230 where the ink sticks 206 are converted into a liquid 231. The gravity portion of the feed path may be a very short distance or may be a substantial portion of the distance between the insertion and delivery stations.

The liquid 231 is jetted upon a print drum 232 to form an image 234. The image 234 advances in the direction of arrow 236 where sheets 238 from a sheet feeder 240 combine with the image 234. The image 234 is imprinted onto the sheet 238 with the assistance of a pressure roller 242. A printer controller 243 sends signals to the motor transmission assembly 222, the sheet feeder 240 and the print drum 232 to control the operation of the printer 202.

Figure 3:
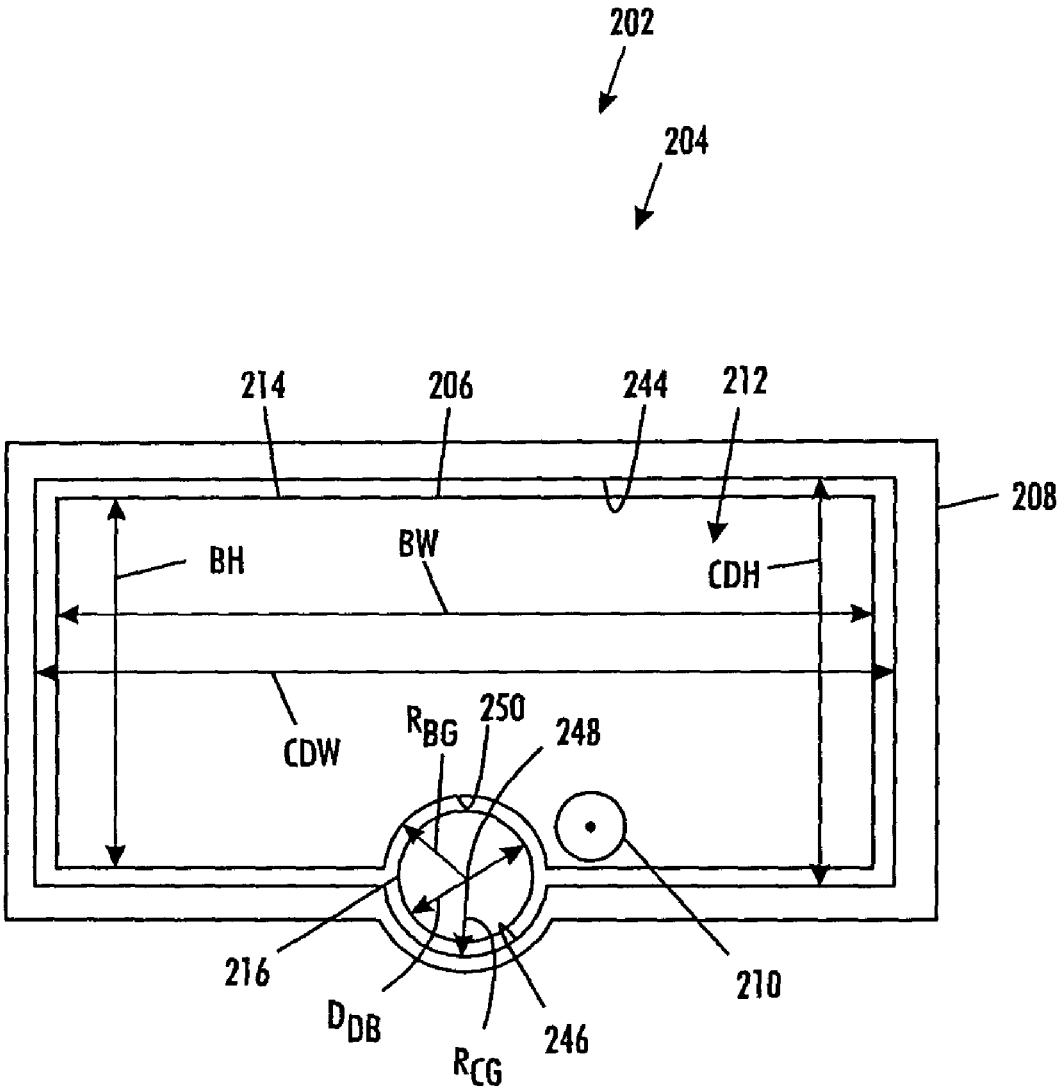
FIG. 3 is a cross sectional view of the solid ink delivery system of FIG. 2 along the line 3-3 in the direction of the arrows.

The solid ink stick 206 is shown in FIG. 2 positioned in the opening 212 of the guide or chute 208. The stick 206 and the chute 208 may have any suitable shape. For example, as is shown in FIG. 3, for simplicity the stick periphery 214 may have a generally rectangular shape and may be defined by a width BW and a height BH.

Since the sticks 206 move within the chute 208, the opening 212 in the chute 208 may, for simplicity, be likewise rectangular and have a size slightly larger than that of the sticks 206. For example, the opening 212 may have a chute opening width COW which is slightly larger than the stick width BW. Similarly, the chute may have a chute opening height COH which is slightly larger than the stick height BH. The chute 208 includes an internal periphery 244 for shape cooperation with the external periphery 214 of the stick 206.

The internal periphery 244 of the chute 208 includes a chute belt guide 246 for guiding the drive belt 216 along its path 210. The chute belt guide 246 of chute 208 may, as shown in FIG. 3, have a generally semi-circular cross section defined by radius $R_{CG}$ extending from origin 248. The stick 206 may include a stick belt guide 250 which, as is shown in FIG. 3, may have a generally semi-circular cross section defined by radius $R_{BG}$ extending from origin 248.

Alternatively, the drive belt 216 and the stick belt guide 250 may have any suitable shape and consequently any suitable shape or cross section. As is shown in FIG. 3, the belt 216 may, for simplicity, have a circular cross section defined by diameter $D_{DB}$. The radius $R_{CG}$ of the chute belt guide 246 and the radius $R_{BG}$ of the stick belt guide 250 may be selected such that the drive belt 216 may be contained within the chute belt guide 246 and the stick belt guide 250 to properly constrain the drive belt 216 and such that the sticks 206 engage with the belt 216 to properly advance the sticks 206 in the chute 208.

At least a portion of the belt 216 should be contained within the chute 208 and contact the stick 206 over at least a portion of the ink stick travel range. The stick belt guide 250 may be positioned anywhere along the periphery 212 of the sticks 206. Similarly, the chute belt guide 246 may be positioned along the periphery 244 of the chute 208 in any position. The belt 206 may be centrally positioned within the chute 208 to optimally advance the sticks 206 in the chute 208.

For example, and as shown in FIG. 3, the chute belt guide 246 is centrally positioned in the chute 208 to receive the belt 216. Similarly the stick belt guide 250 may be centrally positioned relative to the stick 206.

In order that the ink stick 206 be able to slide smoothly along the chute 208, potential contact surfaces of the chute 208 should be made of a material that provides a coefficient of friction between the internal periphery 244 of the chute 208 and the external periphery 212 of the sticks 206 that is low enough to permit the easy flow or movement of the sticks 206 in the chute 208. Conversely, the coefficient of friction between the periphery 244 of the chute 208 and the belt 216 should be sufficiently low to permit the advancement of the belt 216 within the chute belt guide 246 of the chute 208. The coefficient of friction between the belt 216 and the sticks 206 should be sufficiently high to cause the belt 216 to engage the sticks 206 and to cause the belt 216 to properly advance the sticks 206 along the chute 208. Friction values are not definite and will vary based on numerous factors of a given system, such as stick size, stick to stick interfaces, angle of travel relative to gravity and so forth.

Referring again to FIG. 2, the belt 216 advances into the chute 208 from belt guide inlet opening 252 to the chute belt guide 246. The belt 216 exits the chute belt guide 246 at belt guide outlet opening 254. The belt 216 then is received by the drive pulley 218 and advanced toward the idler pulley 220. The belt 216 then reenters the belt guide inlet opening 252. The progressive position of the drive pulley and idler pulley or pulleys relative to the belt travel direction can be in any order appropriate to chute and drive system configuration.

Additional ink sticks may be installed or loaded into the solid ink delivery system from either end 256 of the chute 208 or in a direction normal to the end 256 of the chute 208. For simplicity, the ink sticks 216 are preferably loaded proximate the end 256 of the chute 208.

It is important that the proper ink stick be loaded into the appropriate chute of the machine. To assure the loading of proper ink sticks, keyed stations are utilized to permit the entry of the proper ink stick and to prohibit the entry of an improper ink stick. This is particularly valuable on color machines where four separate sticks of different colors are to be loaded into the same machine.

Figure 4:
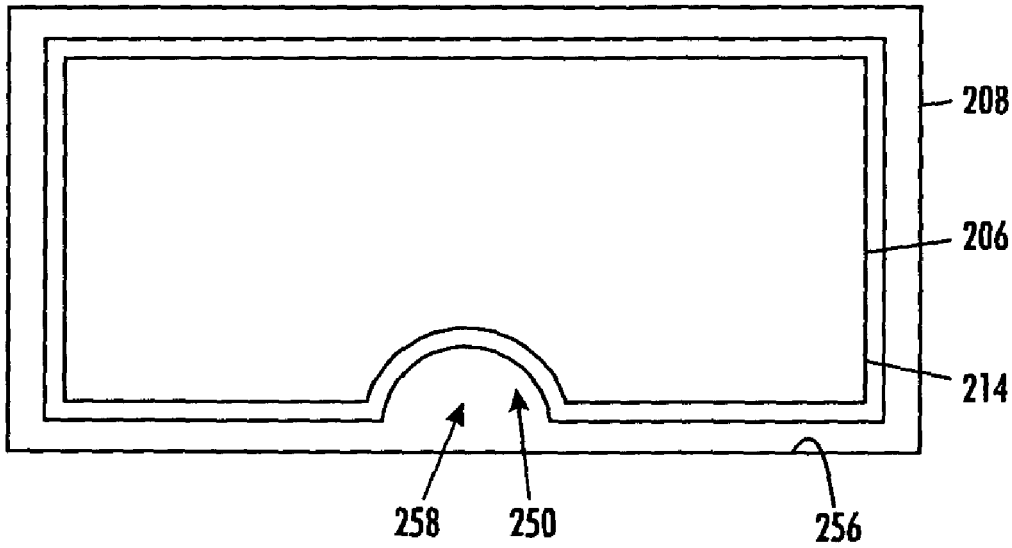
FIG. 4 is a cross sectional view of the solid ink delivery system of FIG. 2 along the line 4-4 in the direction of the arrows.

For example, and as is shown in FIG. 4, the stick belt guide 250 formed in the periphery 214 of the stick 206 may be utilized as a keying device for the stick 206. The chute 208 includes a chute key 258 positioned in end 256 of the chute 208 that aligns with the stick belt guide 250 of the sticks 206. The chute key 258 only permits an ink stick such as stick 206 with stick belt guide 250 to fit correctly into the chute 208.

Figure 5:
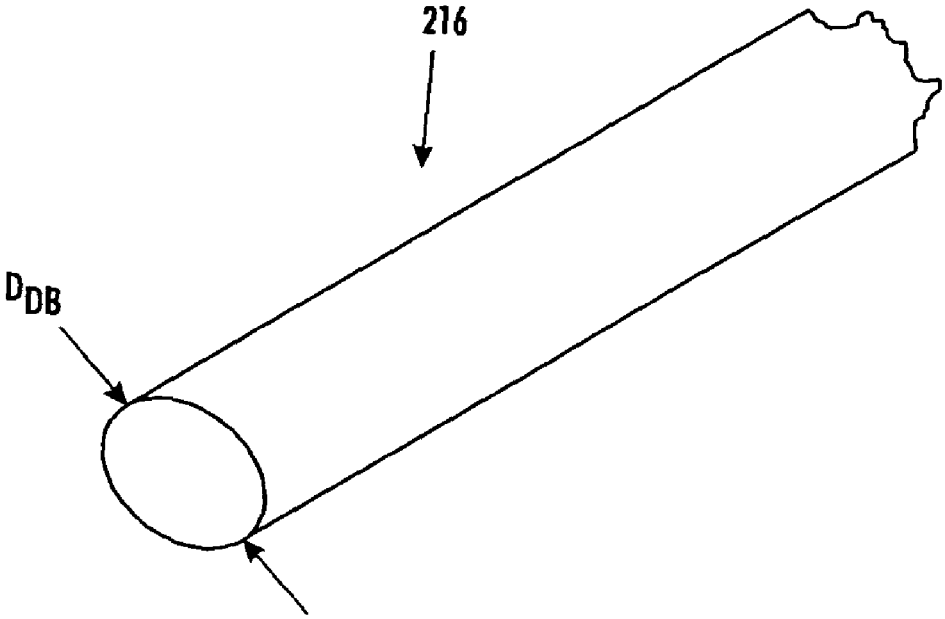
FIG. 5 is a partial plan view of the drive member of the solid ink delivery system of high speed, solid ink printer of FIG. 2.

Referring now to FIG. 5, the belt 216 is shown in greater detail. The belt 216 may have a constant diameter defined by diameter $D_{DB}$ and may be sized to properly advance the sticks 206. The belt 216 may be made of any suitable, durable material. For example, the belt 216 may be made of a plastic or elastomer. If made of an elastomer, the belt 216 may be made of, for example, polyurethane.

Figure 6:
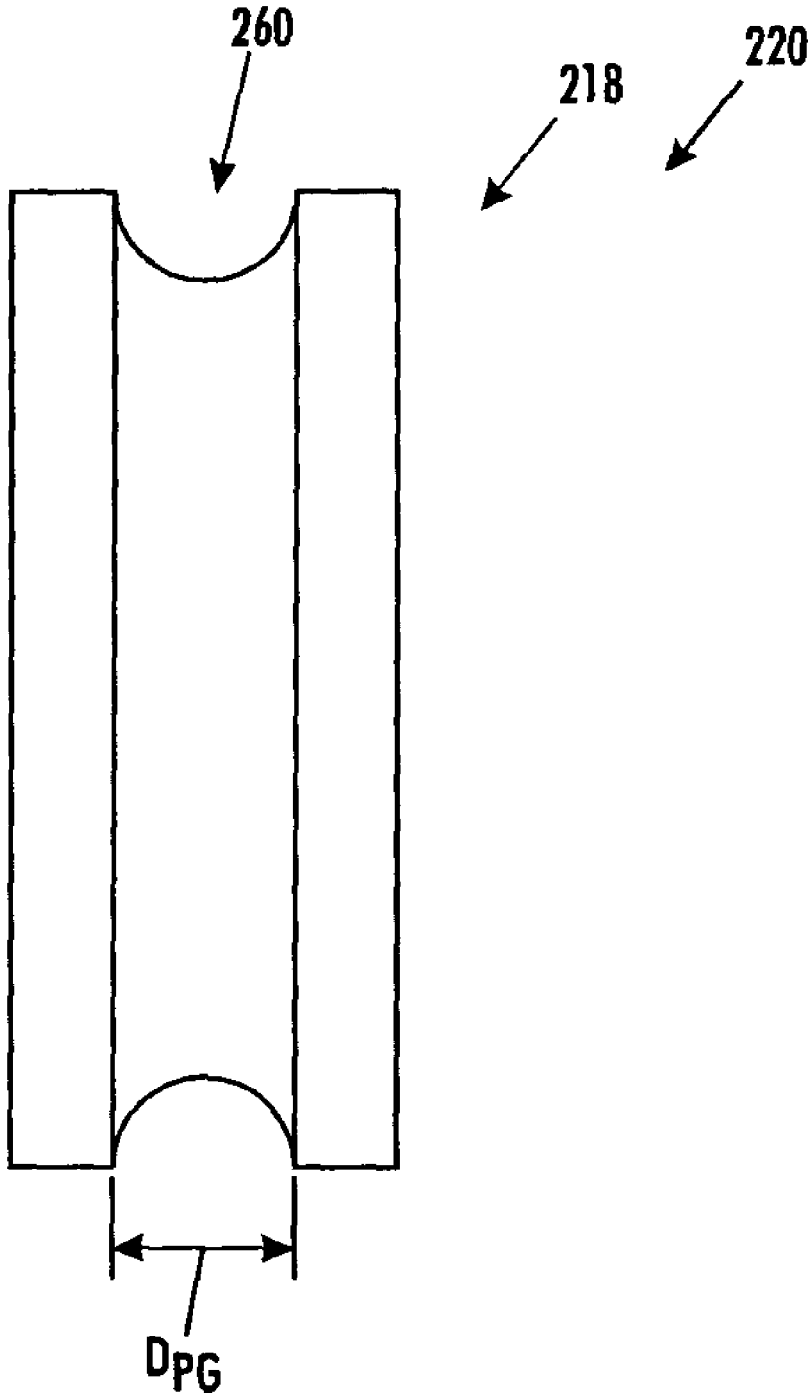
FIG. 6 is a plan view of a pulley for supporting the drive member of FIG. 4.

Now to FIG. 6, pulley 218 and pulley 220 are shown in greater detail. The pulleys 218 and 220 have a similar size and shape and may include a pulley groove 260 for receiving the belt 216. The pulley groove 260 may be defined by a diameter $D_{PG}$ and have a diameter similar to that of the diameter $D_{DB}$ of the belt 216. The pulleys 218 and 220 are made of any suitable, durable material and may, for example, be of a plastic. If made of a plastic, for example, the pulley may be made of Acetyl or of a glass reinforced nylon.

Figure 7:
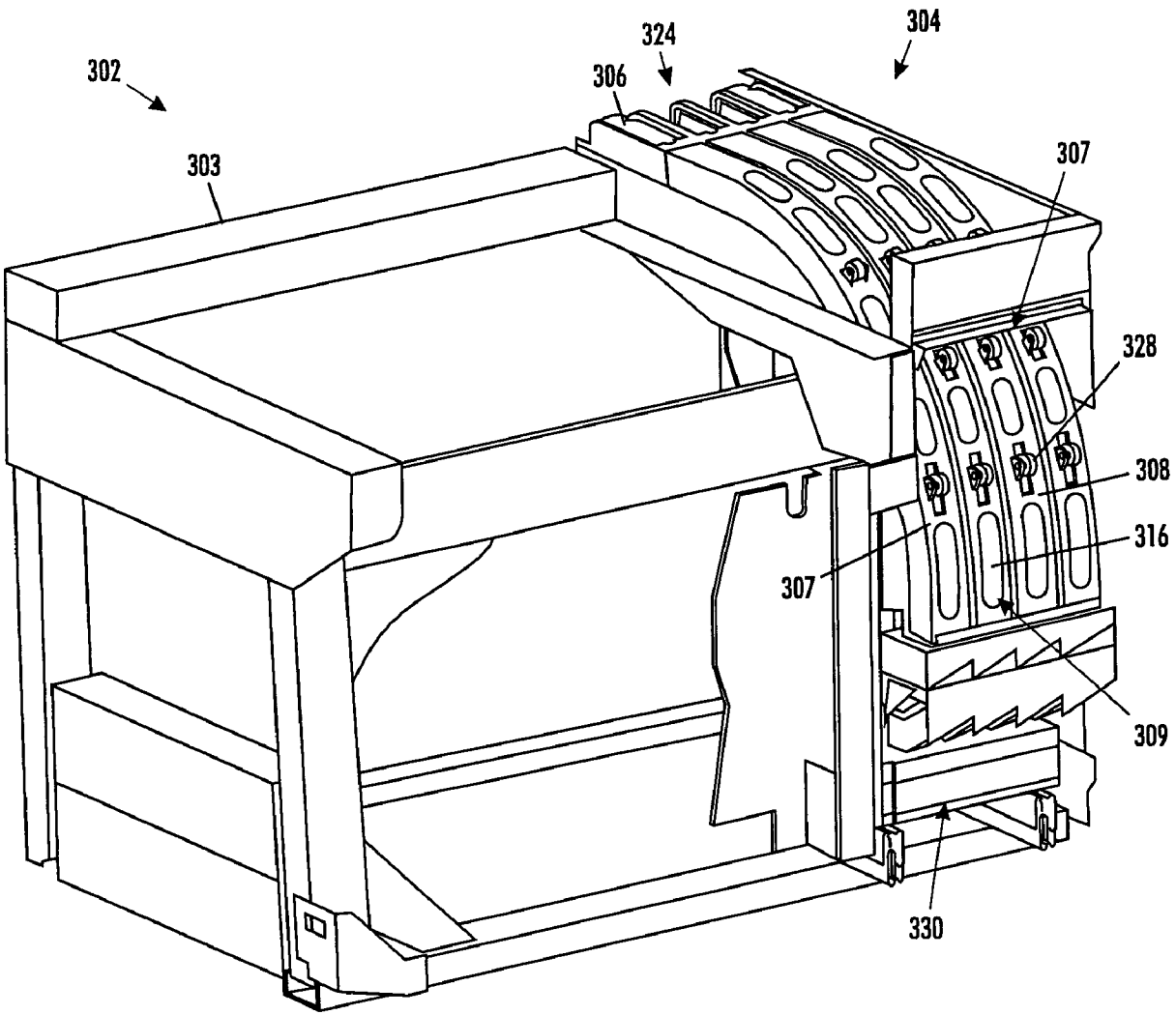
FIG. 7 is a partial cutaway perspective view of another embodiment of the solid ink delivery system in position in a solid ink printer for delivering ink to print heads of the solid ink printer.

Referring now to FIG. 7, another embodiment of the printer with the solid ink delivery system is shown as printer 302. The printer 302 is similar to the printer 202 of FIGS. 1-6 except that the printer 302 is a multi-color printer. The printer 302 utilizes four separate color ink sticks 306 which have respectively the colors black, cyan, magenta and yellow. The printer 302 of FIG. 7 also has a chute 308 which is different than the chute 208 of the printer 202 of FIGS. 1-6 in that the chute 308 includes an arcuate portion 307. It should be appreciated that a solid ink color printer may be designed without a chute having an arcuate portion. The arcuate portion may be comprised of a single or multiple arc axes, including continuously variable 3 dimensional arc paths, any combination of which can be of any length relative to the full arcuate portion. The term arcuate refers to these and any similar, non linear configuration.

The printer 302, as shown in FIG. 7, has a frame 303 which is used to support solid ink delivery system 304. The solid ink delivery system 304 advances the sticks 306 from loading station 324 near the top of the printer 302 to melting station 330 near the bottom of the printer 302. The solid ink delivery system 304 includes a plurality of feed chutes 308. A separate feed chute 308 is utilized for each of the four colors: namely cyan, magenta, black and yellow.

As shown in FIG. 7, the ink loader 304 may include longitudinal openings 309 for viewing the progress of the sticks 306 within the individual feed chutes 308 and also to reduce cost and weight. Nudging members 328 may be positioned along the chute 308 for nudging the sticks 306 against belt 316.

Figure 8:
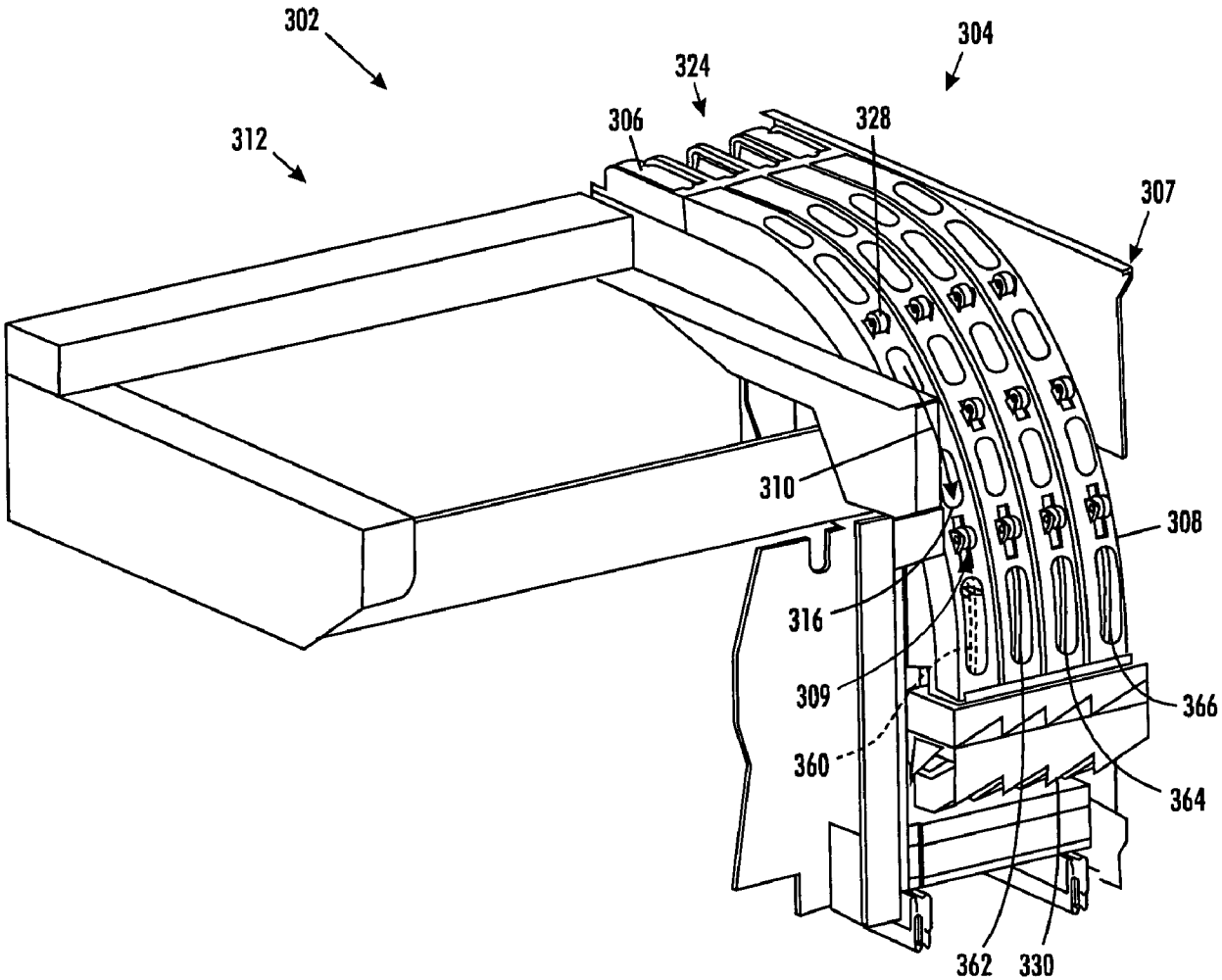
FIG. 8 is a partial cutaway perspective view of the solid ink delivery system of FIG. 7 in position in a solid ink printer for delivering ink to print heads of the solid ink printer, showing the ink delivery system in greater detail.

Referring now to FIG. 8, the solid ink delivery system 304 of the printer 302 is shown in greater detail. The solid ink delivery system 304 incorporates four solid ink delivery subsystems, each consisting, in part, of a load or receiving section, a feed chute and a melt unit. For example, and as is shown in FIG. 8, the solid ink delivery system 304 includes a black solid ink delivery sub-system 360. The black ink delivery sub-system 360 is similar to the solid ink delivery system 204 of the printer 202 of FIGS. 1-6 except that the chute 308 of the solid ink delivery sub-system 360 has an arcuate portion 307.

The solid ink delivery system 304 further includes a second, third and fourth solid ink delivery sub-system 362, 364 and 366 providing for cyan, yellow and magenta ink sticks respectively. The colors have been described in a specific sequence but may be sequenced in any order for a particular printer. Keyed insertion openings define which color will be admitted into a sub-system color chute of the solid ink delivery system 304. Each of the solid ink delivery sub-systems 360, 362, 364 and 366 may be positioned parallel to each other and may have similar components. For simplicity, the black solid ink delivery sub-system 360 will be described in greater detail. It should be appreciated that the other sub-systems 362, 364 and 366 have similar components and operate similarly to the black solid ink delivery sub-system 360.

The black solid ink delivery sub-system 360 includes the chute 308 for holding a number of ink sticks 306 and guiding them in a prescribed path 310 from loading station 324 to the melting station 330. The chute 308 may have an insertion opening with any suitable shape such that only one color of an ink stick set may pass through the opening. The black solid ink delivery sub-system 360 further includes a drive member in the form of belt 316 which provides for engagement with a plurality of the ink sticks 306 and extends along a portion of the prescribed path 310 of the solid ink delivery sub-system 360. In operation, the chute 308 may be loaded with several sticks.

Figure 9:
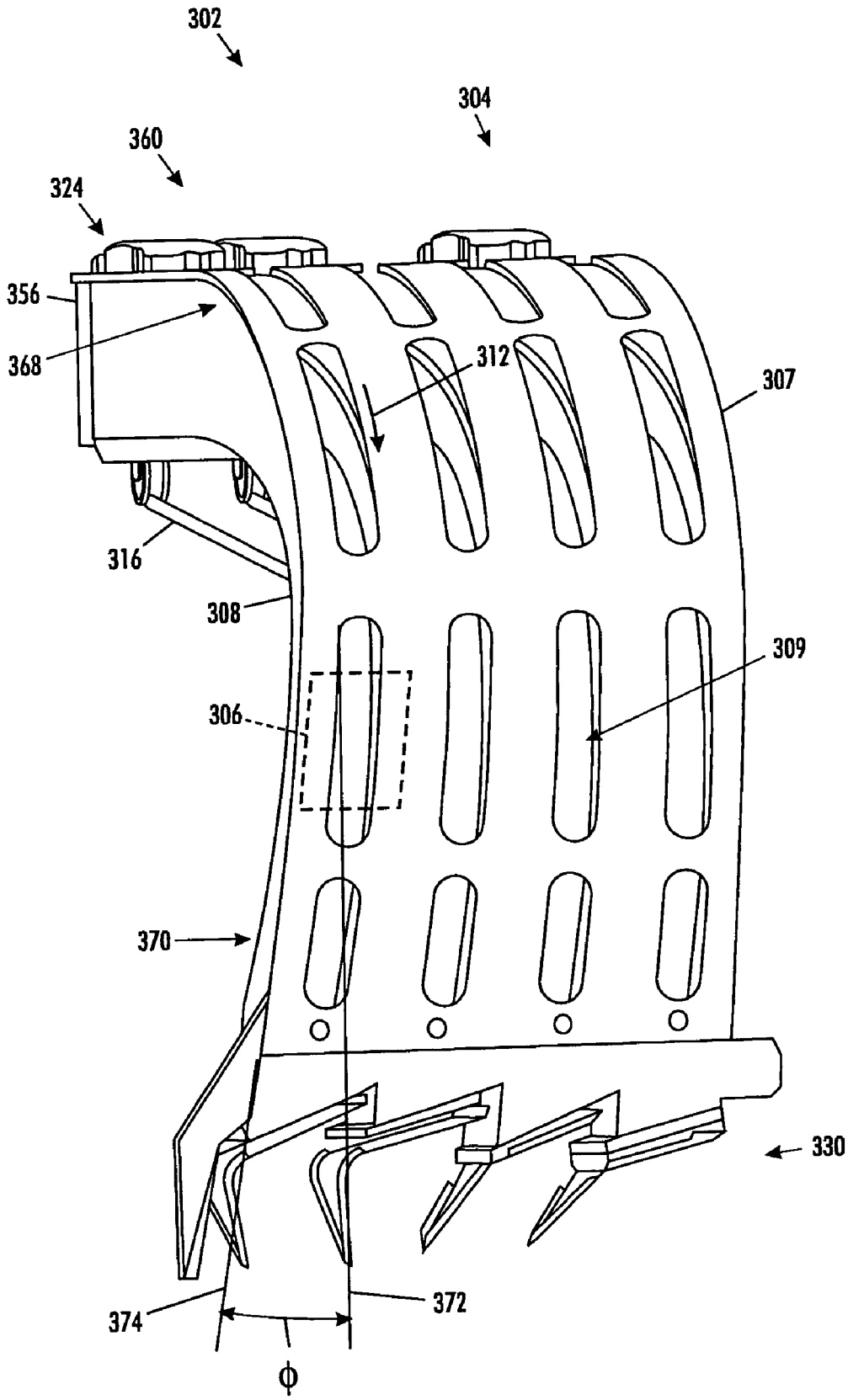
FIG. 9 is a perspective view of the guide for the ink sticks of the solid ink delivery system of FIG. 7 in position in a solid ink printer for delivering ink sticks to print heads of the solid ink printer.

While the chute 308 may have any suitable shape, for example, and as shown in FIG. 9, the chute 308 may include a first linear portion 368 adjacent the loading station 324. As shown in FIG. 9, the first linear portion 368 may be horizontal such that the ink stick 306 may be inserted into the end 356 of the chute 308 in a simple horizontal motion in the top of the printer 302 or the stick may be inserted vertically through a keying feature (not shown) into the chute and then advanced horizontally.

To better utilize the space within the printer 302, the chute 308 may have a shape that is not linear such that a greater number of ink sticks 306 may be placed within the printer 302 than the number possible with a linear chute. For example, and as shown in FIG. 9, the chute 308 may include, in addition to the first linear portion 368, arcuate portion 307 extending downwardly from the first linear portion 368 of the chute 308. The chute 308 may further include a second linear portion 370 extending downwardly from the arcuate portion 307 of the chute 308. The second linear portion 370 may be substantially vertical and be positioned over the melting station 330 such that the ink sticks 306 may be delivered to the melting station 330 by gravity.

The chute may lay within a single plane, for example, plane 372. Alternatively, and as shown in FIG. 9, the chute 308 may extend through a series of non-parallel planes. For example, and as shown in FIG. 9, the chute 308 may move downwardly and outwardly to an angled plane 374 which is skewed with respect to the vertical plane 372. The planes 372 and 374 form an angle $\phi$ there between. The angle $\phi$ may be any angle capable of providing for a larger number of ink sticks 306 in chute 308.

Figure 10:
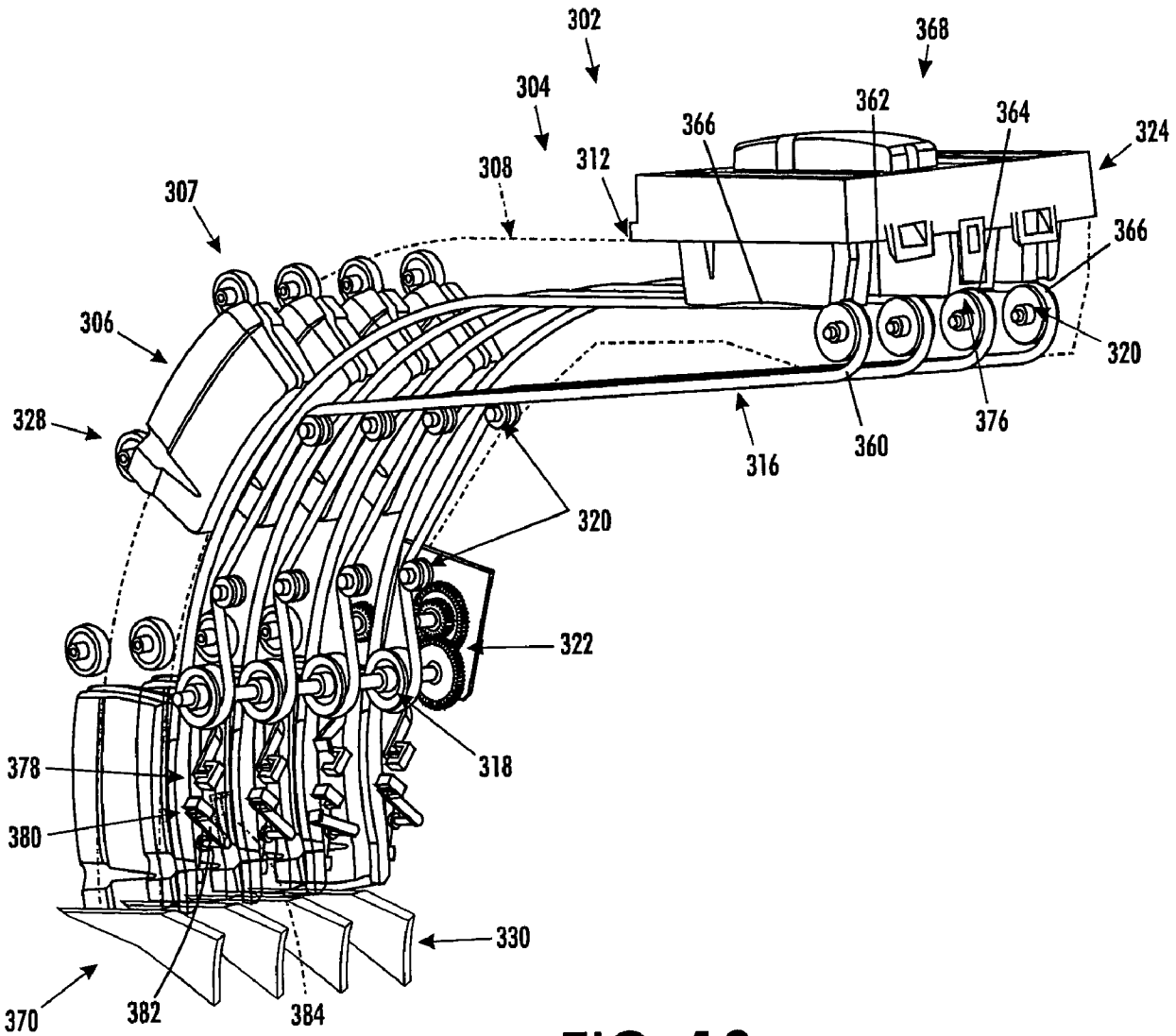
FIG. 10 is a perspective view of the guide assembly including the drive member for advancing the ink sticks of the solid ink delivery system of FIG. 7 toward the print heads of the solid ink printer.

Referring now to FIG. 10, the drive belt 316 of the solid ink delivery system 304 of the printer 302 is shown in greater detail. The drive belt 316 may require that a portion of the belt 316 have a shape to conform to the chute 308. The conforming shape may be in the arcuate portion 307 of the chute 308, as well as in the first linear portion 368 and the second linear portion 370 of the chute 308. The belt 316 may be driven, for example, by a motor transmission assembly 322 which is used to rotate drive pulley 318.

The drive belt 316 may for example have a circular cross section and be a continuous belt extending from the drive pulley 318 through a series inlet idler pulleys 320 and chute 308. Nudging members 328 in the form of, for example, pinch rollers that may be spring loaded and biased toward the belt 316 to assure sufficient friction between the belt 316 and the ink sticks 306 such that the ink sticks do not fall by gravity and slip away from the belt 316.

The solid ink delivery system 304 of the printer 302 may further include a series of sensors for determining the presence or absence of the ink sticks 306 within different portions of the chute 308. An inlet sensor assembly 376 may be used to indicate additional ink sticks 306 may be added to the chute 308. The inlet sensor assembly 376 may be positioned near loading station 324. A low sensor assembly 378 may be used to indicate a low quantity of ink sticks 306 in the chute 308. The low sensor assembly 378 may be positioned spaced from the melt station 330.

An out sensor assembly 380 may be used to indicate the absence of ink sticks 306 in the chute 308. The out sensor assembly 380 may be positioned adjacent to the melt station 330. The sensor assemblies 376, 378 and 380 may have any suitable shape and may, for example, and as is shown in FIG. 10, be in the form of pivoting flags that pivot about a wall of the chute 308 and transition a switch, such as a micro switch or an optical interrupter. The presence of a stick 306 causes the flags to move from first position 382, as shown in phantom, to second position 384, as shown in solid. A sensor or switch may be used to determine whether the flags 376, 378 or 380 are in the first position 382 or in the second position 384. Other sensing devices may be used in conjunction with or in place of a mechanical flag system, such as a proximity switch or reflective or retro-reflective optical sensor.

Figure 10A:
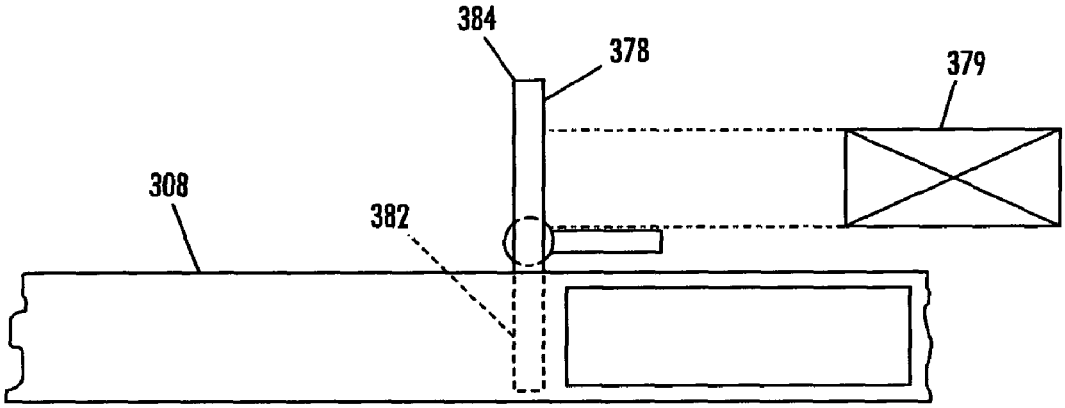
FIG. 10A is a partial plan view of a flag in position in the guide assembly of FIG. 10.

Referring now to FIG. 10A, flag 378 is shown in position in wall of the chute 308. The flag 378 pivots about a wall of the chute 308. The presence of a stick 306 causes the flag 378 to move from first position 382, as shown in phantom, to second position 384, as shown in solid. A sensor or switch 379 may be used to determine whether the flag 378 is in the first position 382 or in the second position 384.

Figure 11:
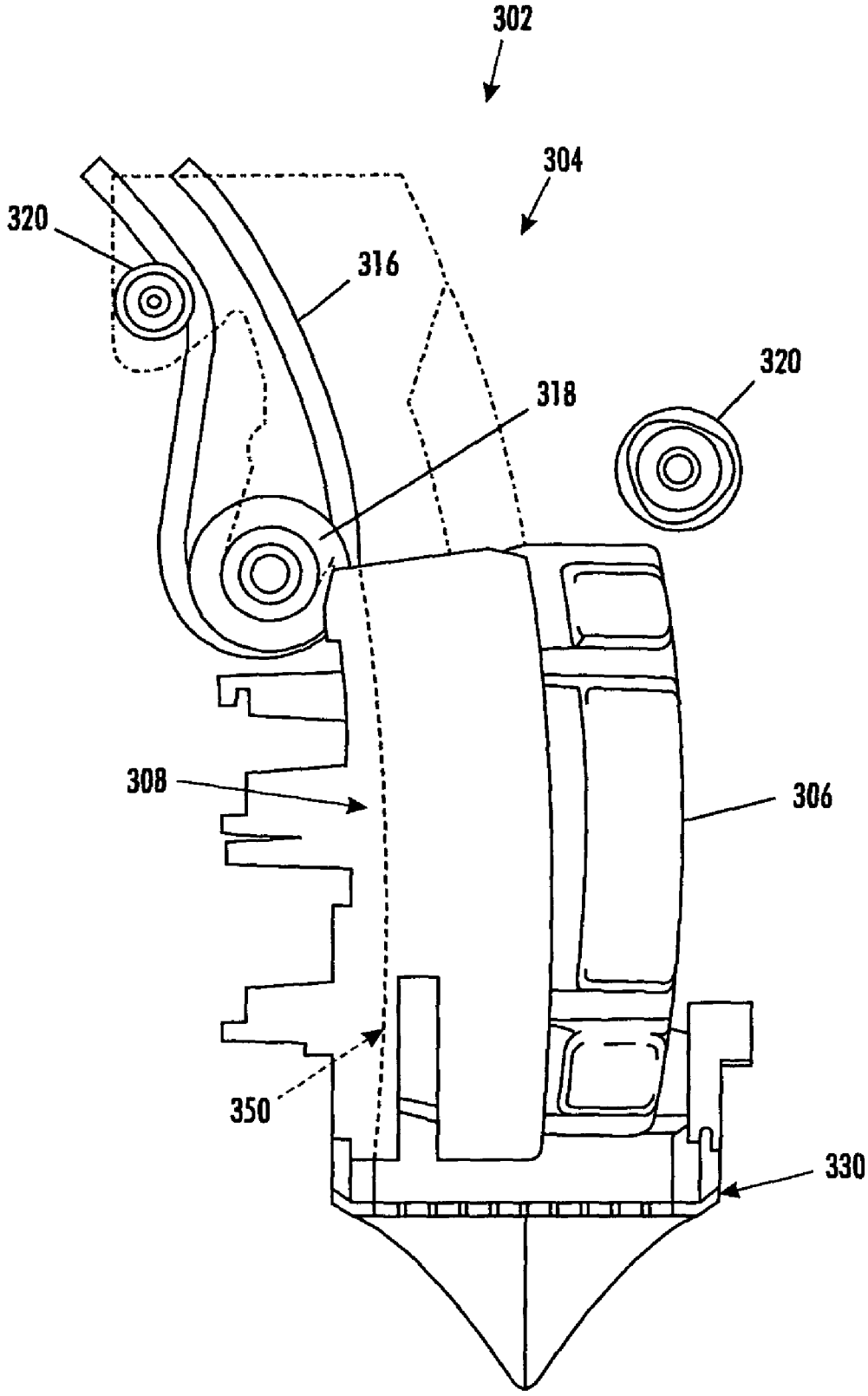
FIG. 11 is partial perspective view of the guide assembly including the drive member for advancing the ink sticks of the solid ink delivery system of FIG. 7 showing the portion adjacent the print heads in greater detail.

Referring now to FIG. 11, the solid ink delivery system 304 of the printer 302 is shown in the location around the melt station 330. As shown in FIG. 11, the drive pulley 318 and the belt 316 are positioned somewhat away from an ink stick 306 when the stick 306 is in the melt station 330. The spacing of the belt 316 away from the ink stick 306 when the ink stick 306 is in the melt station 330 may permit gravity to be the only factor causing the ink stick 306 to be forced against a melt unit when the belt is stopped. If the belt 316 continues to run, however, additional sticks 306, if present, may contact the belt 316 and push against the lower stick 306, urging it toward the melt station 330.

It should be appreciated that, alternatively, the pulley 318 may be positioned low enough that the ink stick 306 may be in contact with the pulley 318 when the stick 306 is in the melt station 330. With such configuration, the belt 316 may ensure sufficient forces are exerted on the ink stick 306 to maintain ink stick 306 contact against the melt unit.

Figure 12:
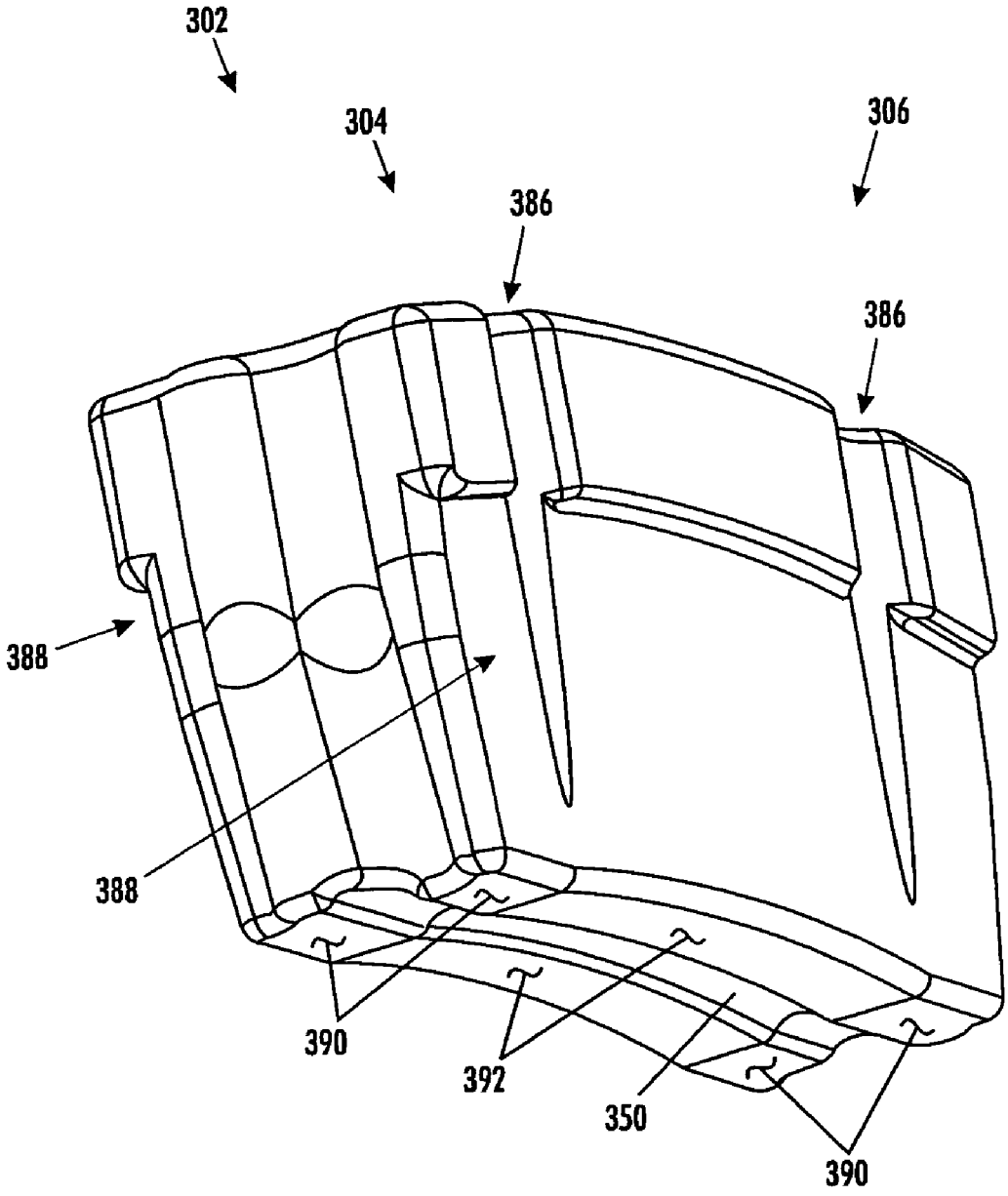
FIG. 12 is a perspective view of an ink stick for use with the guide assembly for advancing the ink sticks of the solid ink delivery system of FIG. 7 toward the print heads of the solid ink printer.

Referring now to FIG. 12, an ink stick 306 for use with the printer 302 of FIGS. 7-11 is shown in greater detail. The ink stick 306 shown in FIG. 12 includes a series of vertical keying features used, among other things, to differentiate sticks of different colors and different printer models. The stick keying features are used to admit or block insertion of the ink through the keyed insertion opening of the solid ink delivery system 304. The ink stick 306 further includes a series of horizontal shaped features 388 for guiding, supporting or limiting feed of the ink stick 306 along the chute 308 feed path. It should be appreciated that keying and shaped features can be configured to accomplish the same functions with a horizontal or other alternate loading orientation.

The ink stick 306, as shown in FIG. 12, includes two spaced-apart pairs of spaced-apart flat portions 390, one pair on each end of the stick 306, for accommodating the linear portions of the ink feed path, as well as a centrally located pair of spaced apart arcuate portions 392, to accommodate the curved or arcuate portion of the ink feed path 310. The ink stick groove 350 likewise has linear and arcuate portions.

Figure 13:
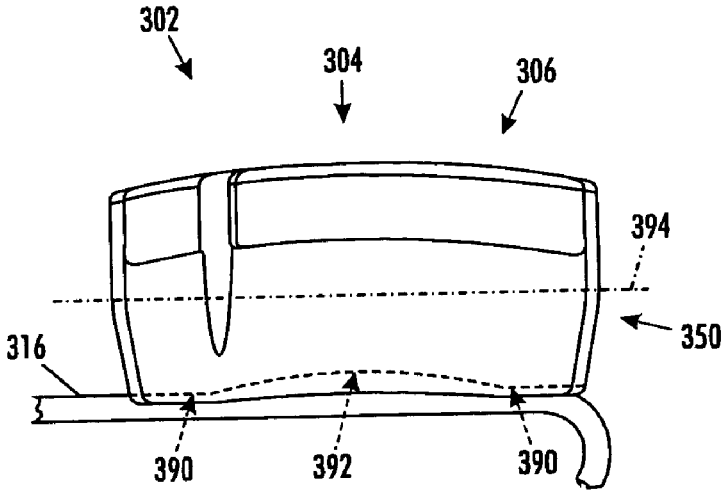
FIG. 13 is a plan view of the ink stick of FIG. 12 in position on a flat portion of the drive member of FIG. 10.

Referring now to FIG. 13, the ink stick 306 is shown in position on a linear portion of the belt 316 of the solid ink delivery system 304 of the printer 302. The ink stick 306 contacts the belt 316 at the end portions 390 of the ink stick 306 and the groove 350 formed in the ink stick 306 cooperates with the belt 316 to advance the stick 306.

As shown in FIG. 13, the ink stick 306 is arcuate or curved along longitudinal axis 394.

Figure 14:
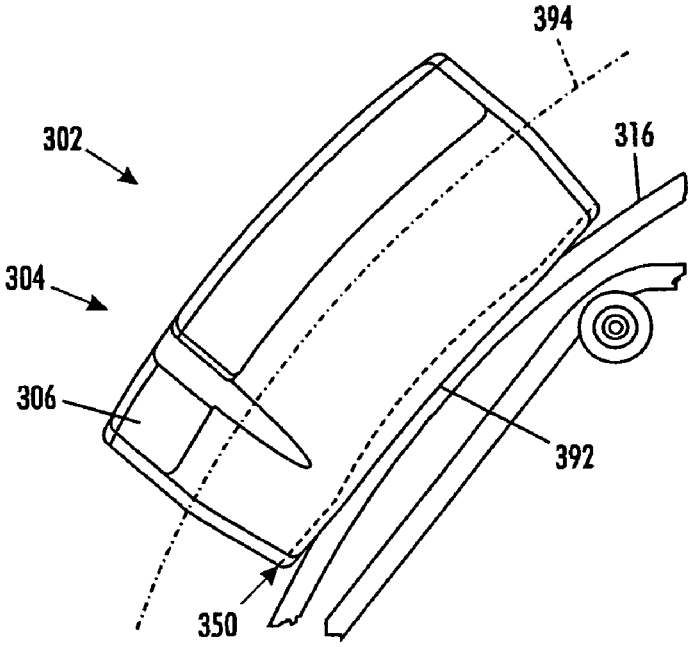
FIG. 14 is an plan view of the ink stick of FIG. 12 in position on a curved portion of the drive member of FIG. 10.

Referring to FIG. 14, the ink stick 306 is shown in position along an arcuate portion of the belt 316. As shown in FIG. 14, the central arcuate portion 392 of the ink stick 306 engages with the belt 316.

Figure 15:
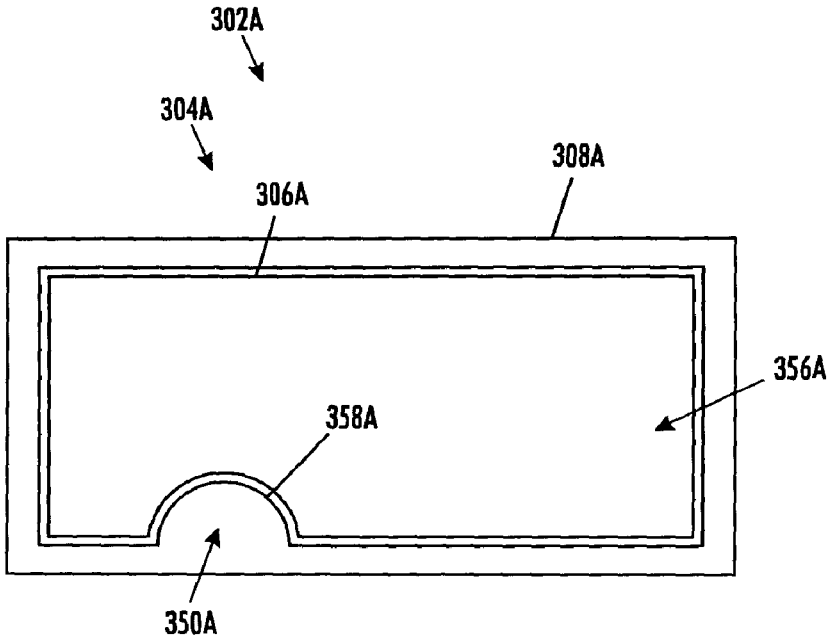
FIG. 15 is a cross sectional view of a drive member and chute of a solid ink delivery system for use in a printing machine with the drive member being not centrally positioned with respect to the chute and the ink stick according to another embodiment.
Figure 16:
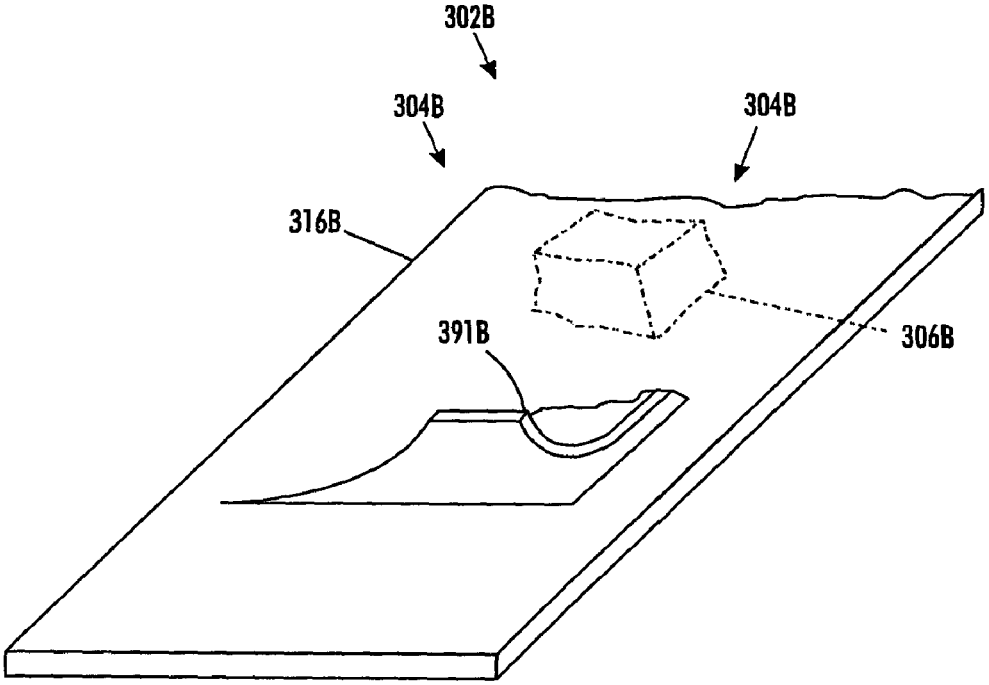
FIG. 16 is a perspective view of a flat drive member with a cog for use in a solid ink delivery system of a printing machine according to another embodiment.

Referring now to FIG. 15, yet another embodiment is shown as printer 302A which utilizes a solid ink delivery system 304A. The solid ink delivery system 304A is similar to the solid ink system 304 of FIGS. 7-14 except that the solid ink delivery system 304A includes an ink stick 306A which has a non centered stick belt guide 350A Referring now to FIG. 16, yet another embodiment is shown as printer 302B which includes a solid ink delivery system 304B which includes a belt 316B which has a rectangular cross section or is flat. It should be appreciated that the belt 316B may include cogs 391B which are formed on a surface of the belt 316B for contact with the sticks 306B.

Figure 17:
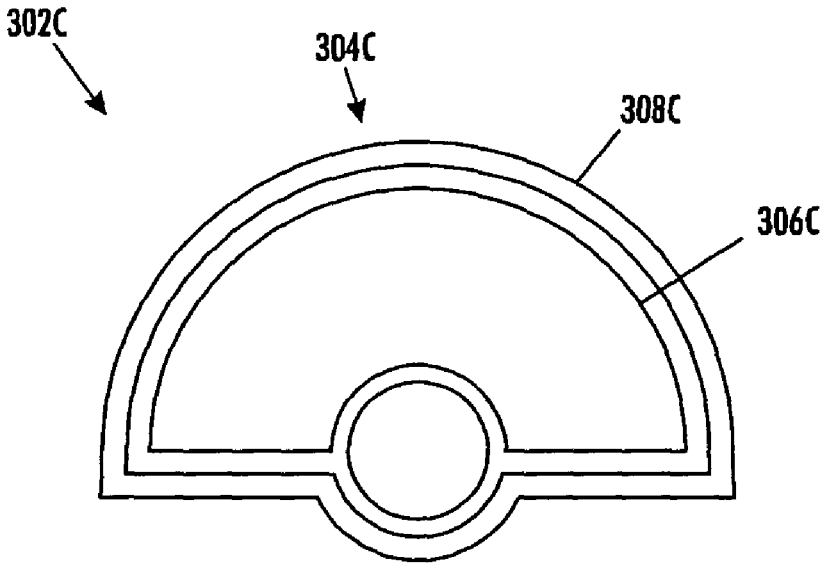
FIG. 17 is a cross sectional view of a D-shaped chute with a drive member of a solid ink delivery system for use in a printing machine according to another embodiment.

Referring now to FIG. 17, yet another embodiment, is shown as printer 302C which includes solid ink delivery system 304C which is different than the ink delivery system 304 of FIGS. 7-14 in that the ink delivery system 304C includes a chute 308C which is semi-circular and has a stick 306C which mates with the chute 308C.

Figure 18:
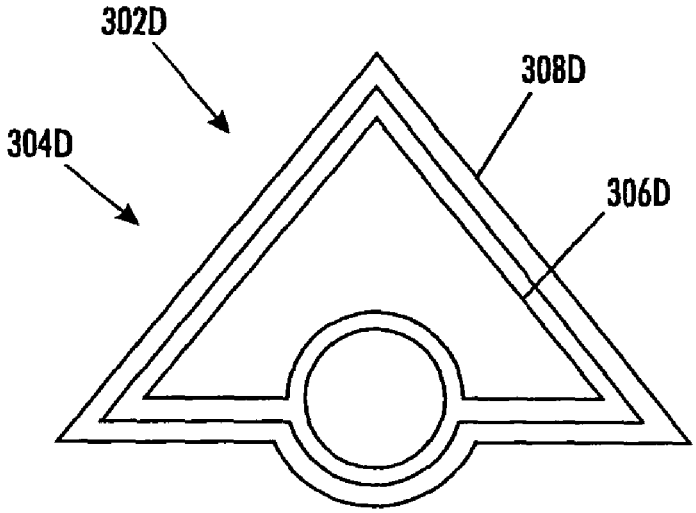
FIG. 18 is a cross sectional view of a triangular-shaped chute with a drive member of a solid ink delivery system for use in a printing machine according to another embodiment.
Figure 19:
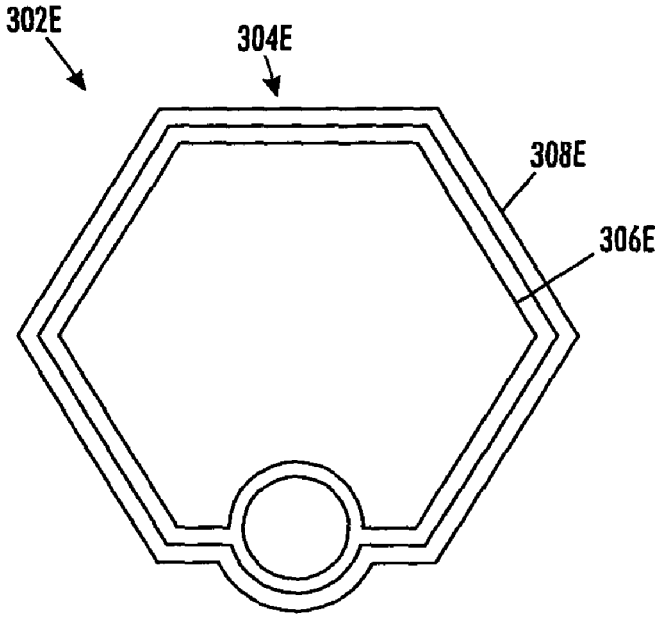
FIG. 19 is a cross sectional view of a hexagonal-shaped chute with a drive member of a solid ink delivery system for use in a printing machine according to another embodiment.

Referring now to FIG. 18, another embodiment is shown as printer 302D which includes a solid ink delivery system 304D which is different than the ink delivery system 304 of FIGS. 7-14 in that ink delivery system 304D includes a chute 308D which is triangular. The triangular chute 308D receives a triangular ink stick 306D.

Yet another embodiment is shown as printer 302E which includes a solid ink delivery system 304E which is different than the ink delivery system of 304 of FIGS. 7-14 in that the ink delivery system 304E includes a chute 308E which is hexagonal and cooperates with a hexagonal ink stick 306E.

Yet another embodiment is shown as printer 302F which includes a solid ink delivery system 304F which is different than the ink delivery system 304 of FIGS. 7-14 in that the ink delivery system 304F includes a chute 308F which is pentagonal and cooperates with a stick 306F which is also pentagonal.

The chute configuration examples shown in the various alternative embodiments are depicted as fully matching the ink shape at least in one sectional axis. The chute need not match the ink shape in this fashion and need not be completely encircling. One or more sides may be fully or partially open or differently shaped. The side surfaces of the chute do not need to be continuous over the chute length. The chute need only provide an appropriate level of support and/or guidance to complement reliable loading and feeding of ink sticks intended for use in any configuration.

Referring now to FIG. 21, yet another embodiment is shown as printer 402. The printer 402 includes a solid ink delivery system 404. The ink delivery system 404 includes a chute 408 in which ink sticks 406 are designed to pass through. The chute 408 accommodates a plurality of the ink sticks 406. The ink sticks 406 are advanced from loading station 424 along prescribed path 410 to delivery station 429 adjacent melt station 430.

As shown in FIG. 21, the delivery system 404 includes a drive member in the form of a belt 416 to urge the sticks 416 along prescribed path 410 to delivery station 429. The belt 416 extends from the loading station 424 to the delivery station 429 adjacent the melt station 430. The belt 416 thus urges the sticks 406 into the melt station 430 and against the melting units 431.

Referring now to FIG. 22, yet another embodiment is shown as printer 502. The printer 502 includes a solid ink delivery system 504. The solid ink delivery system 504 includes a chute 508 in which ink sticks 506 are designed to pass through. The chute 508 accommodates a plurality of the ink sticks 506. The ink sticks 506 are advanced from loading station 524 along prescribed path 510 to delivery station 529 adjacent melt station 530.

As shown in FIG. 22, the delivery system 404 includes a drive member in the form of a belt 516 to urge the sticks 516 along prescribed path 510 to delivery station 529. The belt 516 extends from the loading station 524, but does not extend to the delivery station 529. The belt 516 ends before the delivery station 529. If the belt continues to push the sticks downwardly to the delivery station once a stick has reached the end of the belt 516, it should be appreciated that the belt may contribute to urge the sticks 506 into the melt station 530 and against the melting units 531, provided the ink stick stack length extends to the belt. If, however, the belt 516 is halted once a stick has reached the end of the belt, only gravity will urge full sticks or a portion of a stick that lies beyond the end of the belt into the melt station 430 and against the melting units 431 even if the ink stick stack length extends into the area of belt influence.

Referring now to FIG. 23, yet another embodiment is shown as printer 602. The printer 602 includes a solid ink delivery system 604. The solid ink delivery system 604 includes a chute 608 to which ink sticks 606 are designed to pass through. The chute 608 accommodates a plurality of the ink sticks 606. The ink sticks 606 are advanced from loading station 624 along prescribed path 610 to delivery station 629 adjacent melt station 630.

As shown in FIG. 23, the delivery system 604 includes a drive member in the form of a series of wheels 616 to urge the sticks 606 along prescribed path 610 to delivery station 629. The wheels 616 have a periphery 615 that contacts exterior 613 of the sticks 606 and urges them from the loading station 624 to the delivery station 629. The wheels 616 may be small and confined within the chute 608 or be positioned mostly outside the chute 608 with an opening 617 in the chute 608 permitting the wheel 616 to contact the sticks 606. If the wheels 616 continue to push the sticks 606 downwardly to the delivery station 629 once a stick 606 has reached the end of the lowest wheel 616, it should be appreciated that the wheel 616 may contribute to urge the sticks 606 into the melt station 630 and against the melting units 631. If, however, the wheels 616 are halted once a stick 606 has reached the end of the wheels 616, only gravity will urge the bottom stick 606 into the melt station 630 and against the melting units 631.

It should be appreciated that any of the solid ink printers, for example printers 202, 302, 402, 502 and 602 may include a drive member in the form of a belt or wheel that may be configured such that the belt or wheels are controlled by a reversing motor such that the sticks may be urged in a backward direction up the chute. The reversing motor configuration may be utilized to unload the sticks from the delivery system and to clear jams.

Variations and modifications of the transport system are possible, given the above description. However, all variations and modifications which are obvious to those skilled in the art to which the present transport system pertains are considered to be within the scope of the protection granted by this Letters Patent.

What is claimed is:

1. A solid ink delivery system for use with a plurality of solid ink sticks in solid ink printers, said delivery system comprising:

a guide configured to direct solid ink sticks along a prescribed path within the guide that extends from an insertion area to a solid ink melting device in a solid ink printer; and a belt aligned with a portion of the guide and configured to engage at least one of the solid ink sticks in the guide and to move the solid ink sticks in the guide along at least a portion of the prescribed path in the guide that extends from the insertion area to the solid ink melting device.

2. The solid ink delivery system of claim 1, wherein the prescribed path includes a first portion that is arcuate and a second portion that is linear.

3. The solid ink delivery system of claim 1, wherein the prescribed path includes a portion that is arcuate in at least one axis.

4. The solid ink delivery system of claim 1, wherein the prescribed path within the guide includes a first portion that is linear and defines a first path axis and a second portion that is linear and defines a second path axis, the second path axis is not co linear with the first path axis and the second path axis forms an angle with the first path axis.

5. The solid ink delivery system of claim 1, wherein said belt comprises a generally circular cross section.

6. The solid ink delivery system of claim 1:

wherein the ink stick defines a longitudinal axis thereof; and wherein said belt is adapted to engage the ink stick along the longitudinal axis of the ink stick.

7. The solid ink delivery system of claim 1, wherein said belt is a polyurethane belt.

8. A solid ink delivery system for use with a plurality of solid ink sticks in solid ink printers, said delivery system comprising:

a guide configured to direct solid ink sticks along a prescribed path within the guide that extends from an insertion area to a solid ink melting device in a solid ink printer, the prescribed path includes a first portion and a second portion; and a drive member that extends along the first portion of the prescribed path in said guide, the drive member being configured to engage at least one of the solid ink sticks in the guide and to move the solid ink sticks in the guide along at least the first portion of the prescribed path in the guide that extends from the insertion area to the solid ink melting device, and said drive member is spaced from the second portion of the prescribed path in said guide, the second portion being configured to enable movement of the stick in the guide by gravity.

9. A solid ink delivery system for use with a plurality of solid ink sticks in solid ink printers, said delivery system comprising:

a guide configured to direct solid ink sticks along a prescribed path within the guide that extends from an insertion area to a solid ink melting device in a solid ink printer; and a drive member aligned with a portion of the guide and configured to contact a solid ink stick in the guide frictionally and to move the solid ink sticks in the guide along at least a portion of the prescribed path in the guide that extends from the insertion area to the solid ink melting device, and to slip relative to the ink stick in response to the frictionally contacted solid ink stick being obstructed in the guide.

10. A solid ink delivery system for use with a plurality of solid ink sticks in solid ink printers, said delivery system comprising:

a guide configured to direct solid ink sticks along a prescribed path within the guide that extends from an insertion area to a solid ink melting device in a solid ink printer;

a drive member aligned with a portion of the guide and configured to engage at least one of the solid ink sticks in the guide and to move the solid ink sticks in the guide along at least a portion of the prescribed path in the guide that extends from the insertion area to the solid ink melting device; and a power source configured to advance the drive member in a first direction along the guide and to reverse movement of the drive member along the guide.

11. The solid ink delivery system of claim 10 further comprising:

a sensor positioned proximate to the guide to indicate a solid ink stick being present in the guide.

12. A solid ink delivery system for use with a plurality of solid ink sticks in solid ink printers, said delivery system comprising:

a guide configured to direct solid ink sticks along a prescribed path within the guide that extends from an insertion area to a solid ink melting device in a solid ink printer;

a drive member aligned with a portion of the guide and configured to engage at least one of the solid ink sticks in the guide and to move the solid ink sticks in the guide along at least a portion of the prescribed path in the guide that extends from the insertion area to the solid ink melting device; and a nudging member having a biasing member, the nudging member being configured to act on a surface of the solid ink stick to urge the solid ink stick towards the drive member.

13. A solid ink imaging device including a delivery system for use with a plurality of solid ink sticks, said device comprising an ink delivery system having:

a guide configured to direct solid ink sticks along a prescribed path within the guide that extends from an insertion area to a solid ink melting device in a solid ink printer; and a belt aligned with a portion of the guide and configured to engage simultaneously a plurality of the solid ink sticks in the guide and to move the solid ink sticks in the guide along a portion of the prescribed path in the guide that extends from the insertion area to the solid ink melting device.

14. The solid ink imaging device of claim 13, wherein the prescribed path includes a portion that is arcuate.

15. A solid ink imaging device including a delivery system for use with a plurality of solid ink sticks, said device comprising an ink delivery system having:

a guide configured to direct solid ink sticks along a prescribed path within the guide that extends from an insertion area to a solid ink melting device in a solid ink printer, the prescribed path having a first portion and a second portion; and a drive member extending along the first portion of the prescribed path in the guide and configured to engage simultaneously a plurality of the solid ink sticks in the guide and to move the solid ink sticks in the guide along the first portion of the prescribed path in the guide that extends from the insertion area to the solid ink melting device, and said drive member is spaced from the second portion of the prescribed path in said guide, the second portion being configured to enable movement of the stick in the guide by gravity.

* * * * *